US005875724A

United States Patent [19]

Ito

[11] Patent Number: 5,875,724

[45] Date of Patent: Mar. 2, 1999

[54] FORWARD AND REVERSE FABRIC FEED CONTROL DEVICE WITH FEED CONTROL CAMS FOR BUTTONHOLE SEWING MACHINE

[75] Inventor: Minoru Ito, Nagoya, Japan

[73] Assignee: Brother Kogyo Kabushiki Kaisha, Nagoya, Japan

[21] Appl. No.: 995,214

[22] Filed: Dec. 19, 1997

[30] Foreign Application Priority Data

Dec. 25, 1996 [JP] Japan ..... 8-344913

[51] Int. Cl.[6] ..... D05B 27/02; D05B 27/22; D05B 3/06

[52] U.S. Cl. ..... 112/66; 112/316; 112/462; 112/323

[58] Field of Search ..... 112/65, 323, 324, 112/314, 1, 317, 446, 448, 462, 313

[56] References Cited

U.S. PATENT DOCUMENTS

| | | | |
|---|---|---|---|
| 3,108,555 | 10/1963 | Engel | 112/316 X |
| 3,636,900 | 1/1972 | Rogers et al. | 112/316 |
| 3,742,881 | 7/1973 | Heine et al. | 112/316 |
| 3,766,871 | 10/1973 | Mastuda et al. | 112/316 |
| 4,577,575 | 3/1986 | Stevens et al. . | |

FOREIGN PATENT DOCUMENTS

| | | |
|---|---|---|
| B2-56-50997 | 12/1981 | Japan . |
| Y2-58-18856 | 4/1983 | Japan . |
| B2-58-31946 | 7/1983 | Japan . |
| 59-8687 | 3/1984 | Japan . |

*Primary Examiner*—Ismael Izaguirre
*Attorney, Agent, or Firm*—Oliff & Berridge, PLC

[57] ABSTRACT

A fabric feeding device for a sewing machine, including a horizontally and vertically reciprocable feed dog, a feed control cam member with a forward and a reverse feed cam for controlling forward and reverse feed distances of the feed dog, a manually operated feed adjusting member for operating the cam member, a control plate operated by the cam member for changing the angle of a feed regulator for adjusting the fabric feed distances, an auxiliary feed cam member operated by a manually operated buttonhole stitching pattern selector member, an auxiliary feed plate positioned by the auxiliary feed cam member and cooperating with the feed control cam member to move the control plate, a buttonhole reverse feed auxiliary cam member operated by the feed adjusting member, and a buttonhole fine feed adjusting lever rotatably supported by a manually operated buttonhole fine feed adjusting masher and positioned by the buttonhole reverse feed auxiliary cam member for positioning the auxiliary feed plate, wherein a small-feed part of the reverse feed cam is shaped so as not to disturb positioning of the control plate by the auxiliary cam member, buttonhole fine feed adjusting lever and auxiliary feed plate.

22 Claims, 19 Drawing Sheets

FORWARD AND REVERSE FABRIC FEED CONTROL DEVICE WITH FEED CONTROL CAMS FOR BUTTONHOLE SEWING MACHINE

This application is based on Japanese Patent Application No. 8-344913 filed Dec. 25, 1996, the content of which is incorporated hereinto by reference.

BACKGROUND OF THE INVENTION

1. Field of the Invention

The present invention relates to a fabric feeding device and a fabric feed control device of a sewing machine.

2. Discussion of the Prior Art

A commonly known feed adjusting device of a sewing machine is adapted such that the feed distance or amount or stitch length is adjustable by an operator-controlled member within a range in which stitching is possible in the sewing machine. An example of this conventional type of feed adjusting mechanism is shown in FIG. 23, which includes a feed dog 1 for feeding a work fabric, a drive lever 2 for reciprocating the feed dog, a drive cam 3 rotated by a drive shaft (not shown) or a rotary shaft (not shown) driven by the drive shaft, an oscillating rod 4 oscillated by the drive cam 3, a feed regulator 5 associated with the oscillating rod 4 so as to adjust the distance of reciprocation of the feed dog 1 through the drive lever 2, and a feed adjusting cam 6 which is formed integrally with or operatively connected to an operator-controlled member 7, to control the feed regulator 5.

Sewing machines of modern vintage are generally capable of forming a variety of stitching patterns such as buttonhole patterns and so-called "super patterns" on a work fabric. The super patterns are stitching patterns such as super zigzag decorative stitches and triple stitches, which are formed by a combination of forward and reverse stitching actions with the fabric being fed in respective forward and reverse directions. Such sewing machines are adapted to form such patterns by a combination of forward and reverse stitching operations. For example, the sewing machine is arranged such that right and left side parts of a buttonhole pattern are sewn during forward and reverse fabric feeding operations, respectively. Where such a sewing operation is performed on a stretch fabric having a relatively high degree of elasticity, there may arise a considerable difference between the actual fabric feed distances in the forward and reverse fabric feeding operations even when the feed distance of the feed dog is the same in the forward and reverse feeding operations. This difference in the actual fabric feed distance results in a deviation of the sewn pattern from the nominal pattern. In view of this drawback, the recent sewing machines are required to have a fine feed adjustment device capable for intricately adjusting the feed distances of the feed dog in the forward and reverse feeding operations independently of each other, for establishing an optimum balance between the actual forward and reverse fabric feed distances. This fine adjustment device is reqired to:

1) make fine adjustment of the forward and reverse feed distances relative to each other (within a range between about 0.2 mm and about 1 mm, for example) in the feeding operations to form the right and left side parts of a buttonhole pattern, for establishing the optimum balance of the actual forward and reverse fabric feed distances, such that the fine adjustment for the side parts of the buttonhole pattern does not affect the fabric feed distance in the other sewing operations; and 2) make fine adjustment of the forward and reverse feed distances relative to each other in feeding operations to form super patterns (for establishing the optimum balance of the actual forward and reverse fabric feed distances), such that the fine adjustment for the super patterns does not affect the fabric feed distance in the other sewing operations.

Such a fine feed adjustment device for the right and left side parts of buttonhole patterns is disclosed in JP-Y2-58-18856 (laid-open publication for opposition purpose of Japanese Utility Model Application No. 53-155714). This fine feed adjustment device is capable of adjusting the forward and reverse feed distances for the right and left side parts of a buttonhole pattern and making fine adjustment thereof, but is not capable of adjusting the forward and reverse feed distances in the sewing of super patterns. Namely, the fine feed adjustment device is arranged such that shaft 19 and feed regulator 1 engage each other through adjusting pin 9 and other members 6, 7. The engagement of the shaft 19 with the adjusting pin 9 prevents oscillating movements of the feed regulator 1, which are necessary for stitching the super patterns. The fine adjustment of the feed distances for the right and left side parts of the buttonhole pattern undesirably affects the feed distances in the other sewing operations except for the stitching of the super patterns.

JP-Y2-59-8687 (laid-open publication for opposition purpose of Japanese Utility Model Application No. 55-30688) discloses a fine feed adjustment device wherein fine feed adjustment for the right and left side parts of the buttonhole pattern affects the feed distances in the other sewing operations including the stitching of the super patterns. According to this device, the fine adjustment of the forward and reverse feeding distances for the side parts of the buttonhole pattern may disturb the balance between the forward and reverse feed distances in a subsequent sewing operation to form a super pattern, and the fine feed adjustments must be made again for the sewing operation to form the super pattern. This fine feed adjustment device suffers from a similar problem when a buttonhole sewing operation is effected following a sewing operation to form a super pattern.

JP-B2-58-31946 (laid-open publication for opposition purpose of Japanese Patent Application No. 50-41982) discloses a fine feed adjustment device which is adapted so as to maintain feed adjustments which have been made last for the right and left side parts of a buttonhole pattern, even after any other sewing operation, so that the feed adjustments made last for the buttonhole pattern are available for that buttonhole pattern which is to be sewn after the above-indicated other sewing operation. Accordingly, this device eliminates a need of re-adjustment of the forward and reverse feed distances for that buttonhole pattern, which would require a trial or test sewing operation. Further, the feed adjustments for the buttonhole patterns do not affect the feed distances in the other sewing operations. In addition, this fine feed adjustment device is considered to be capable of effecting fine feed adjustments for super patterns.

Although the fine feed adjustment device disclosed in the publication JP-B2-58-31946 is considered to be the best of all discussed above in terms of operating efficiency and feed adjusting functions, the use or application of this type of device is limited to certain types of sewing machines, due to the use of three feed cams which are superposed on each other, for the right and left side parts of a buttonhole pattern and a bar tack part of the buttonhole pattern, respectively, as shown in FIG. 3 of the publication. In this respect, it is noted that the feed distance is zeroed during stitching to form the bar tack. A cam follower device following these three cams is needed, and this cam follower device is required to be movable in the direction in which the cams are superposed on each other. However, such a cam follower device is not necessarily provided on sewing machines currently available. Therefore, the fine feed adjustment device is not applicable to a sewing machine not provided with the cam follower device, or to a sewing machine in which the cam follower device is not movable.

JP-B2-56-50997 (laid-open publication for opposition purpose of Japanese Patent Application No. 50-98833) discloses a fine feed adjustment device capable of effecting fine feed adjustments for optimizing a balance between the forward and reverse fabric feed distances in sewing operations to form super patterns. However, this device is not completely satisfactory to make fine adjustment for the forward and reverse feed distances for the right and left side parts of a buttonhole, since the same operator-controlled member is used and operated in the same manner (rotated) for making the fine feed adjustments for all patterns including buttonhole patterns. More specifically described, the device is not able to make fine adjustment to establish an optimum balance between the actual right and left fabric feed distances once the feed adjustments have been made for the right and left side parts. While the device is highly accurate in the feed cam device, it is not suitable for the fine feed adjustments.

Thus, the known feed adjusting devices except for the device of JP-B2-58-31946 are not capable of making fine adjustment for the forward and reverse feeding distances for both the super patterns and the right and left side parts of buttonholes. Although the feed adjusting device of JP-B2-58-31946 is capable of the fine adjustment for both the super patterns and the buttonhole patterns, this device requires a movable cam follower device, which limits the type of the sewing machine to which the feed adjusting device is applicable.

SUMMARY OF THE INVENTION

It is therefore a first object of the present invention to provide an improved fabric feeding device for a sewing machine, which permits adjustment of the forward and reverse feed amounts relative to each other and which does not use a movable cam follower device as used in the prior art.

It is a second object of this invention to provide an improved fabric feed control device for a sewing machine, which permits adjustment of the forward and reverse feed amounts relative to each other and which does not use a movable cam follower device as used in the prior art.

The first object indicated above may be achieved according to a first aspect of the present invention, which provides a fabric feeding device for a sewing machine, for feeding a work fabric during sewing of a buttonhole pattern having a right side part and a left side part which are sewn by one and the other of a forward feeding and a reverse feeding of the work fabric, and a bar tack part which connects the right and left side parts, the fabric feeding device comprising: (a) a feed dog for feeding the work fabric; (b) a drive lever for horizontally reciprocating the feed dog; (c) an oscillating rod for oscillating the drive lever; (d) a drive cam rotated by a drive source of the sewing machine, to oscillate the oscillating rod; (e) a vertical motion mechanism for vertically reciprocating the feed dog, in synchronization with a horizontal reciprocating movement of the feed dog; a feed regulator associated with the oscillating rod, for changing an oscillating angle of the drive lever; a feed control cam member including a forward feed cam and a reverse feed cam for controlling a forward feed distance and a reverse feed distance of the feed dog, respectively; (f) an operator-controlled feed adjusting member for operating the feed control cam member; (g) a control plate whose position is changed by the feed control cam member, for changing the angle of the feed regulator; (h) an operator-controlled pattern selector member for selecting a stitching pattern to be sewn on the work fabric; (i) an auxiliary feed cam member which has a cam portion and which is operated by the pattern selector member; (j) at least one auxiliary feed plate whose position is changed by the cam portion of the auxiliary feed cam member and which cooperates with the feed control cam member to move the control plate; (k) an operator-controlled buttonhole fine feed adjusting member which is supported by a frame of the sewing machine and whose position is adjustable; (l) a buttonhole reverse feed auxiliary cam member operated by the operator-controlled feed adjusting member; and (m) a buttonhole fine feed adjusting lever rotatably supported by the buttonhole fine feed adjusting member and positioned by the buttonhole reverse feed auxiliary cam member, for positioning the above-indicated at least one auxiliary feed plate, and wherein the reverse feed cam of the feed control cam member is shaped such that a part of the reverse feed cam corresponding to a small-feed range whose upper limit is a predetermined value does not disturb positioning of the control plate by the buttonhole reverse feed auxiliary cam member, the buttonhole fine feed adjusting lever and the at least one auxiliary feed plate.

In the fabric feeding device of the present invention constructed as described above, the work fabric is fed by the feed dog which is horizontally reciprocated by the drive lever horizontally oscillated by the oscillating rod, which in turn is oscillated by the drive cam that is rotated by the drive source of the sewing machine through a suitable drive shaft. The feed dog is reciprocated also vertically by the vertical motion mechanism in synchronization with the horizontal reciprocating movement by the drive lever. The feed regulator is associated with the oscillating rod, for changing the oscillating angle of the drive lever. The forward and reverse feed cams of the feed control cam member are provided for controlling the respective forward and reverse feed distances of the feed dog. The feed control cam member is operated by the operator-controlled feed adjusting member, to change the position of the control plate for changing the angle of the feed regulator. The auxiliary feed cam member having a cam portion is operated by the pattern selector member, and the cam portion functions to change the positions of the at least one auxiliary feed plate, so that the at least one auxiliary feed plate cooperates with the feed control cam member to move the control plate. The operator-controlled buttonhole fine feed adjusting member whose position is adjustable is supported by the machine frame, and the buttonhole reverse feed auxiliary cam member is operated by the operator-controlled feed adjusting member. The buttonhole fine feed adjusting lever is rotatably supported by the buttonhole fine feed adjusting member, such that the position of the buttonhole fine feed adjusting lever is positioned by the buttonhole reverse feed auxiliary cam member, for positioning the at least one auxiliary feed plate. The present fabric feeding device is characterized in that the reverse feed cam of the feed control cam member is shaped such that a part of this cam member corresponding to a small-feed range whose upper limit is a predetermined value does not disturb the positioning of the control plate by the buttonhole reverse feed auxiliary cam member, the buttonhole fine feed adjusting lever and the at least one auxiliary feed plate.

In the present fabric feeding device, the forward and reverse feed distances of the feed dog for sewing a buttonhole pattern can be adjusted relative to each other by the feed control cam member through the control plate and the feed regulator, without using a movable cam follower device as used in the prior art.

Further, when one of the right and left side parts of the buttonhole pattern is sewn with the work fabric being fed in the reverse direction when the operator-controlled pattern selector member is set to an appropriate position. The reverse feed distance of the feed dog can be finely adjusted, within the small-feed range, by using the operator-controlled buttonhole fine feed adjusting member. That is, a rotary motion of the buttonhole fine feed adjusting member causes the buttonhole fine feed adjusting lever to be positioned by the buttonhole reverse feed auxiliary cam member, so that the at least one auxiliary feed plate is accordingly positioned so as to change the position of the control plate for thereby changing the angle of the feed regulator, whereby the reverse feed distance can be finely adjusted through the feed regulator by operation of the buttonhole fine feed adjusting member. In this respect, it is noted that the small-feed part of the reverse feed cam does not disturb the positioning of the control plate by the buttonhole reverse feed auxiliary cam through the buttonhole fine feed adjusting lever and the at least one auxiliary feed plate.

In one preferred form of the present fabric feeding device, the forward feed cam of the feed control cam member includes a reverse feed cam portion for controlling the reverse feed distance of said feed dog. This reverse feed cam portion of the forward feed cam can be used for adjusting the reverse feed distance, when an ordinary sewing operation (e.g., straight stitching operation) other than an operation to sew a buttonhole pattern is performed. In this respect, the buttonhole reverse feed auxiliary cam member is used for controlling the reverse feed distance when the predetermined right or left side part of a buttonhole pattern is sewn. Preferably, the reverse feed cam portion of the forward feed cam includes at least a section corresponding to the small-feed range of the reverse feed cam. This arrangement permits adjustment of the reverse feed distance within the small-feed range, during the ordinary sewing operation, even though the small-feed part of the reverse feed cam is shaped so as to prevent the positioning of the control plate by the buttonhole reverse feed auxiliary cam member, buttonhole fine feed adjusting lever and auxiliary feed plates.

The second object indicated above may be achieved according to a second aspect of the present inventions which provides a fabric feed control device for controlling a feed distance of a horizontally and vertically reciprocable feed dog of a sewing machine for feeding a work fabric during sewing of a buttonhole pattern having a right side part and a left side part which are sewn by one and the other of a forward feeding and a reverse feeding of the work fabric, and at least one bar tack portion which connects the right and left side parts, the fabric feed control device comprising: (a) an operator-controlled selector member for selecting one of stitching operations to sew the right and left side parts and the bar tack portion of the buttonhole pattern; (b) a selector cam member operated by the operator-controlled selector member; (c) a forward feed cam for controlling a forward feed distance of the feed dog for the forward feeding of the work fabric when the stitching operation to sew one of the right and left side parts is selected by the selector member through the selector cam member; (d) a reverse feed cam for controlling a reverse feed distance of the feed dog for the reverse feeding of the work fabric when the stitching operation to sew the other of the right and left side parts is selected by the selector member through the selector cam member; and (e) a bar tack feed control device for controlling a bar tack feed distance of the feed dog for sewing the bar tack portion when the stitching operation to sew the bar tack portion is selected by the selector member through the selector cam member.

In the fabric feed control device for controlling the feed distance of the horizontally and vertically reciprocable feed dog of the sewing machine, the forward and reverse feed distances of the feed dog for forward and reverse feeding of the work fabric to sew the respective right and left side parts of the buttonhole pattern can be adjusted by the respective forward and reverse feed cams, for example. Where the selector cam member is rotated by an operator-controlled feed adjusting member, the right side part of the buttonhole pattern is sewn with the forward feed distance adjusted to an optimum value by the feed adjusting member. Then, the left side part is sewn with the reverse feed distance which may be changed as needed relative to the forward feed distance, by operating the feed adjusting member.

The present fabric feed control device permits adjustment of the forward and reverse feed distances for the right and left side parts of the buttonhole pattern, relative to each other, without requiring a conventionally used movable cam follower device.

The second object may also be achieved according to a third aspect of this invention, which provides a fabric feed control device for controlling a feed distance of a horizontally and vertically reciprocable feed dog of a sewing machine for feeding a work fabric, the fabric feed control device comprising: (a) a feed control cam member having a forward feed cam surface and a reverse feed cam surface which are formed in a mutually opposed relationship with each other, for controlling a forward feed distance and a reverse feed distance of the feed dog for forward and reverse feedings of the work fabric, respectively; (b) a cam follower normally held in engagement with the forward feed cam surface under a biasing force of a biasing member, the cam follower being brought into engagement with the reverse feed cam surface when a force overcoming the biasing force is applied to the cam follower in a direction from the forward feed cam surface toward the reverse feed cam surface; (c) an operator-controlled switching member for applying the force overcoming the biasing force to the cam follower; (d) a mechanism for operatively connecting the cam follower to the feed dog, such that the forward and reverse feed distances change depending upon a position of engagement of the cam follower with the forward and reverse feed cam surfaces; and (e) a straight stitching reverse feed cam portion formed adjacent to one of opposite end portions of the forward feed cam surface, for controlling the reverse feed distance of the feed dog during a straight stitching operation on the work fabric, said straight stitching reverse feed cam portion being opposed to said reverse feed cam surface, the forward feed cam surface being shaped such that the forward feed distance is smaller when the cam follower is in engagement with the above-indicated one end portion of the forward feed cam surface than when the cam follower is in engagement with the other end portion.

The present fabric feed control device also permits adjustment of the forward and reverse feed distances relative to each other by changing the position of engagement of the cam follower with the forward and reverse cam surfaces, with the operator-controlled switching member being operated as needed. The present device does not require a conventionally used cam follower device In addition, the straight stitching reverse feed cam portion of the feed control cam member can be used for controlling the reverse feed distance of the feed dog during a straight stitching operation. Since the straight stitching reverse feed cam portion is opposed to the reverse feed cam surface, the operator of the sewing machine is not required to manually hold the operator-controlled switching member in its position for engagement with the straight stitching reverse feed cam portion.

The second object may also be achieved according to a fourth aspect of this invention, which provides a fabric feed control device for controlling a feed distance of a horizontally and vertically reciprocable feed dog of a sewing machine for feeding a work fabric during sewing of a buttonhole pattern having a right side part and a left side part which are sewn by one and the other of a forward feeding and a reverse feeding of the work fabric, and at least one bar tack portion which connects the right and left side parts, the fabric feed control device comprising: (a) a forward feed cam for controlling a forward feed distance of the feed dog for the forward feeding of the work fabric; (b) a first reverse feed cam for controlling a reverse feed distance of the feed dog for the reverse feeding of the work fabric, within a small-feed range whose upper limit is a predetermined value; (c) a second reverse feed cam for controlling the reverse feed distance within a large-feed range whose lower limit is the above-indicated predetermined value; and (d) a fine reverse feed adjusting device for effecting fine adjustment of the reverse feed distance within the small-feed range, without an influence on the forward feed distance controlled by the first reverse feed cam and on the reverse feed distance controlled by the second reverse feed feed cam within the large-feed range.

The present fabric feed control device also permits adjustment of the forward and reverse feed distances relative to each other by using the fine reverse feed adjusting device, that is, by changing the reverse feed distance within the small-feed ranges. The fabric feed control device does not require a conventionally used cam follower device.

In one preferred form of the fabric feed control device according to the fourth aspect of this invention, the fine reverse feed adjusting device comprises; (i) an operator-controlled selector member for selecting one of stitching operations which includes stitching operations to sew the right and left side parts of the buttonhole pattern; (ii) a selector cam member operated by the operator-controlled selector member; (iii) a buttonhole stitching forward feed control portion including the forward feed cam and operable for controlling the forward feed distance of the feed dog for the forward feeding of the work fabric, based on an operation of the forward feed cam, when the stitching operation to sew one of the right and left side parts of the buttonhole pattern is selected by the operator-controlled selector member through the selector cam member; and (iv) a buttonhole stitching reverse feed control portion including the first reverse feed cam and operable for controlling the reverse feed distance of the feed dog for the reverse feeding of the work fabric, based on an operation of the first reverse feed cam, when the stitching operation to sew the other of the right and left side parts is selected by the selector member through the selector cam member.

The second object may also be achieved according to a fifth aspect of this invention, which provides a fabric feed control device for controlling a feed distance of a horizontally and vertically reciprocable feed dog of a sewing machine for feeding a work fabric during sewing of a super pattern which is sewn by both a forward feeding and a reverse feeding of the work fabric, or a buttonhole pattern having a right side part and a left side part which are sewn by one and the other of the forward and reverse feedings of the work fabric, and at least one bar tack portion which connects the right and left side parts, the fabric feed control device comprising: (a) a super pattern feed cam rotated by a drive source of the sewing machine, for forming the super pattern; (b) a super pattern feed cam follower engageable with the super pattern feed cam; (c) a transmission mechanism for transmitting a motion of the super pattern feed cam follower to the feed dog; (d) a first fine feed adjusting device provided in the transmission mechanism, for changing a ratio of the forward and reverse feed distances of the feed dog which are controlled by the super pattern feed cam for the forward and reverse feedings of the work fabric; (d) an operator-controlled feed control cam member operable for sewing the buttonhole pattern, the feed control cam member including a forward feed cam portion for controlling the forward feed distance of the feed dog for the forward feeding of the work fabric, a first reverse feed cam portion for controlling a reverse feed distance of the feed dog for the reverse feeding of the work fabric, within a small-feed range whose upper limit is a predetermined value, and a second reverse feed cam portion for controlling the reverse feed distance within a large-feed range whose lower limit is the above-indicated predetermined value; and (e) a second fine feed adjusting device for effecting fine adjustment of the reverse feed distance of the feed dog which is controlled by the first reverse feed cam for the reverse feeding of the work fabric within the small-feed range, without an influence on the forward feed distance controlled by the forward feed cam and on the reverse feed distance controlled by the second reverse feed feed cam within the large-feed range, and without an influence on the ratio of the forward and reverse feed distances changed by the first fine feed adjusting device.

The present fabric feed control device also permits adjustment of the forward and reverse feed distances relative to each other by using the first and second fine feeding adjusting devices. The fabric feed control device does not require a conventionally used cam follower device.

BRIEF DESCRIPTION OF THE DRAWINGS

The above and other objects, features, advantages and technical and industrial significance of this invention will be better understood by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described a fabric feeding device for feeding a work fabric in a sewing machine, which includes a fabric feed control device for adjusting the fabric feed amount or distance.

Figure 1:
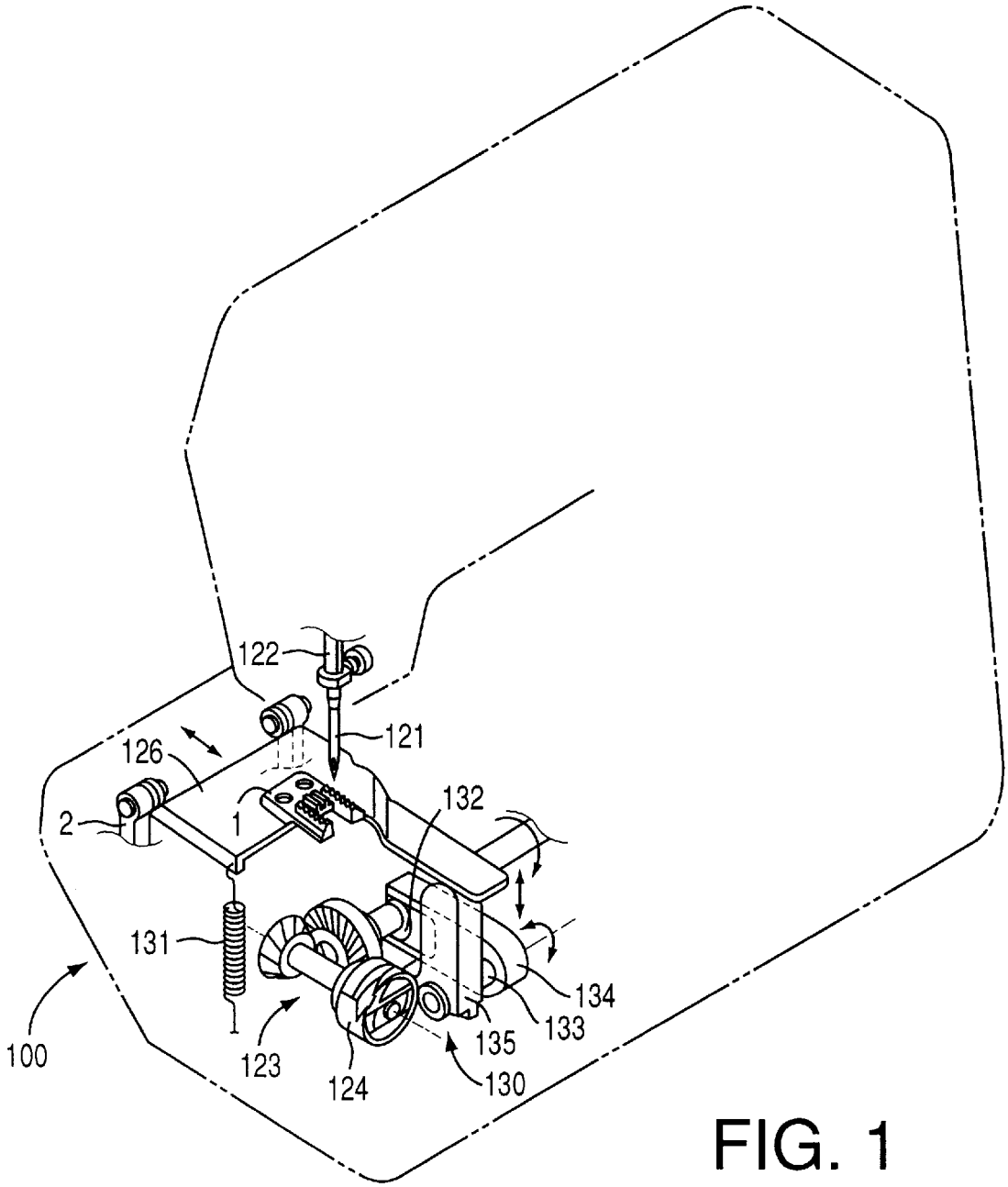
FIG. 1 is a fragmentary perspective view of a sewing machine including a fabric feeding device including a fabric feed control device, which is constructed according to one embodiment of this invention.

Referring first to FIG. 1, there is shown a sewing machine generally indicated at 100, which includes a sewing needle 121 attached to a needle bar 122 that is vertically reciprocated by a drive mechanism driven by a drive source of the sewing machine. Thus, the sewing needle 121 is endwise reciprocated with respect to a work fabric to be sewn. The sewing needle 121 and the needle bar 122 constitute a part of stitch forming instrumentalities for forming stitches on the work fabric. The stitch forming instrumentalities also include: a loop taker drive mechanism 123; a loop taker 124 operated by the loop taker drive mechanism 123; a throat plate 125 (FIG. 2) on which the work fabric is placed; and a feed dog 1 carried by a feed plate 126. The throat plate 125 and the feed dog 1 constitute a part of the above-indicated fabric feeding device, which will be described in detail. The fabric feeding device and the loop taker drive mechanism 123 are driven by the same drive source as used for reciprocating the needle bar 122.

Figure 2:
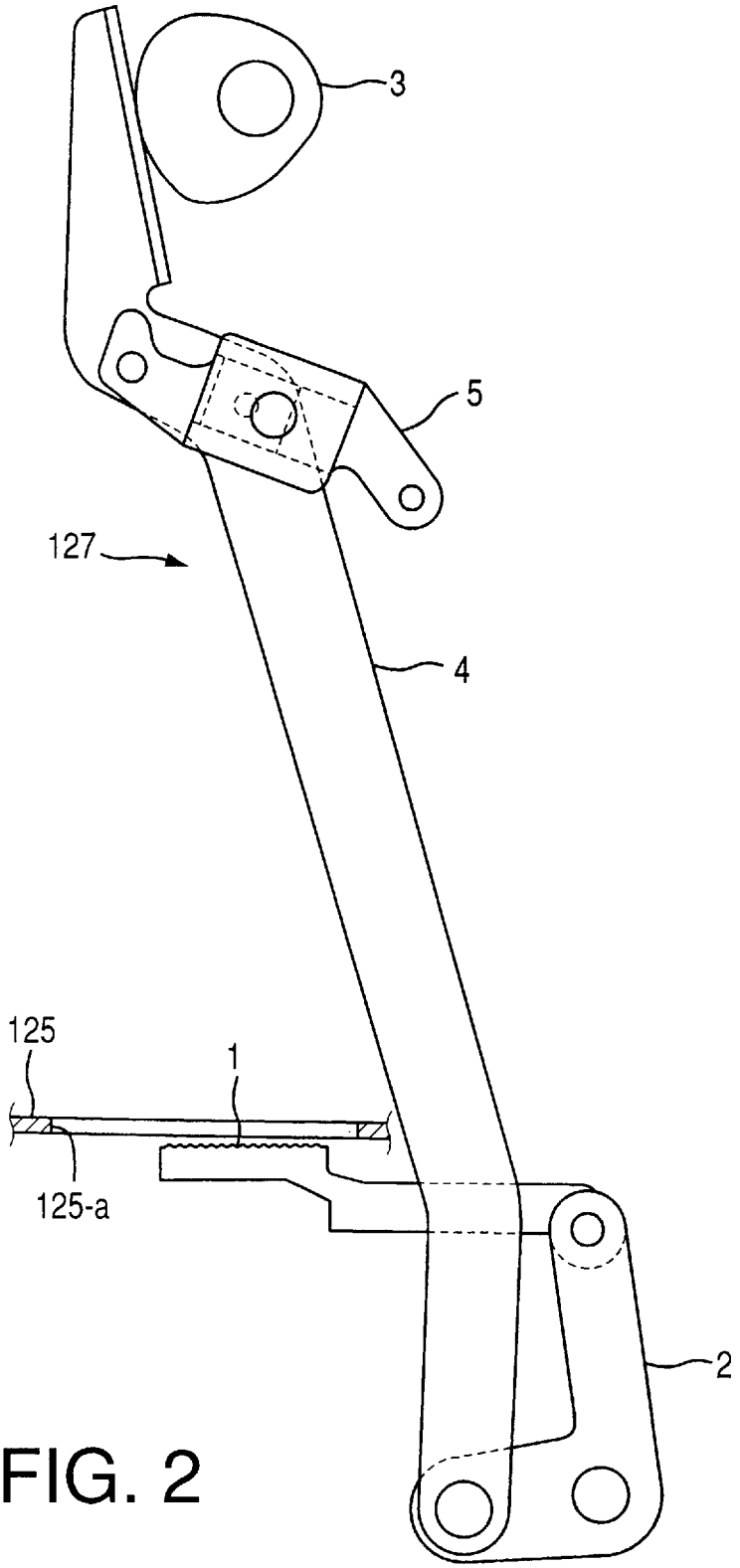
FIG. 2 is an elevational view schematically showing a horizontal motion mechanism of the fabric feeding device of FIG. 1 wherein a feed dog is reciprocated by a drive cam through an oscillating arm and a feed regulator.

Referring next to FIG. 2, the feed dog 1 of the fabric feeding device is located just below an aperture 125-*a* formed through the throat plate 125. The feed dog 1 is horizontally reciprocated by a horizontal motion mechanism generally indicated at 127. Described more specifically, the feed dog 1 is connected at one end thereof to one end of a drive lever 2 such that the feed dog 1 is oscillatingly reciprocated by the drive lever 2. The other end of the drive lever 2 is connected to one end of an oscillating rod 4, which is supported such that the rod 4 is oscillatingly pivotable about an intermediate portion thereof. The oscillating rod 4 is biased at the other end for engagement with a drive cam 3, which is fixed to a drive shaft rotated by the drive source of the sewing machine. In this fabric feeding device, a rotary motion of the cam 3 is converted into a horizontally reciprocating motion of the feed dog 1 for feeding the work fabric. The oscillating rod 4 is provided with a feed regulator 5 whose angle of inclination is adjustable to increase or decrease the feed distance of the feed dog 1 in the fabric feeding direction (horizontal direction as seen in FIG. 2).

The work fabric is fed by a combination of the above-indicated horizontal reciprocating motion of the feed dog 1 by the horizontal motion mechanism 127 described above with reference to FIG. 2, and a vertical reciprocating motion of the feed dog 1 by a vertical motion mechanism 130. The vertical motion mechanism 130 includes a coil spring 131 which biases the feed plate 126 in the downward direction, so that the end portion of the feed plate 126 remote from the end portion pivotally connected to the drive lever 2 is held in contact with a top face of an arm 135. The vertical motion mechanism 130, which also includes the arm 135, further includes a vertical drive cam 132 rotated with a rotary shaft of the loop taker drive mechanism 123. The vertical drive cam 132 engages a bifurcated end portion of a lever 134, while a shaft 133 is fixed to the other end portion of the lever 134. The shaft 133 is associated with the lower end of the above-indicated arm 135. In this arrangement, a rotary motion of the vertical drive cam 132 causes vertical and rotary motions of the shaft 133, whereby the arm 135 is vertically reciprocated so as to vertically oscillate the end portion of the feed plate 126. Thus, the feed dog 1 is vertically reciprocated by the vertical motion mechanism 130, between the upper and lower positions in which the teethed surface of the feed dog 1 is above and below the top surface of the throat plate 125.

Figure 3:
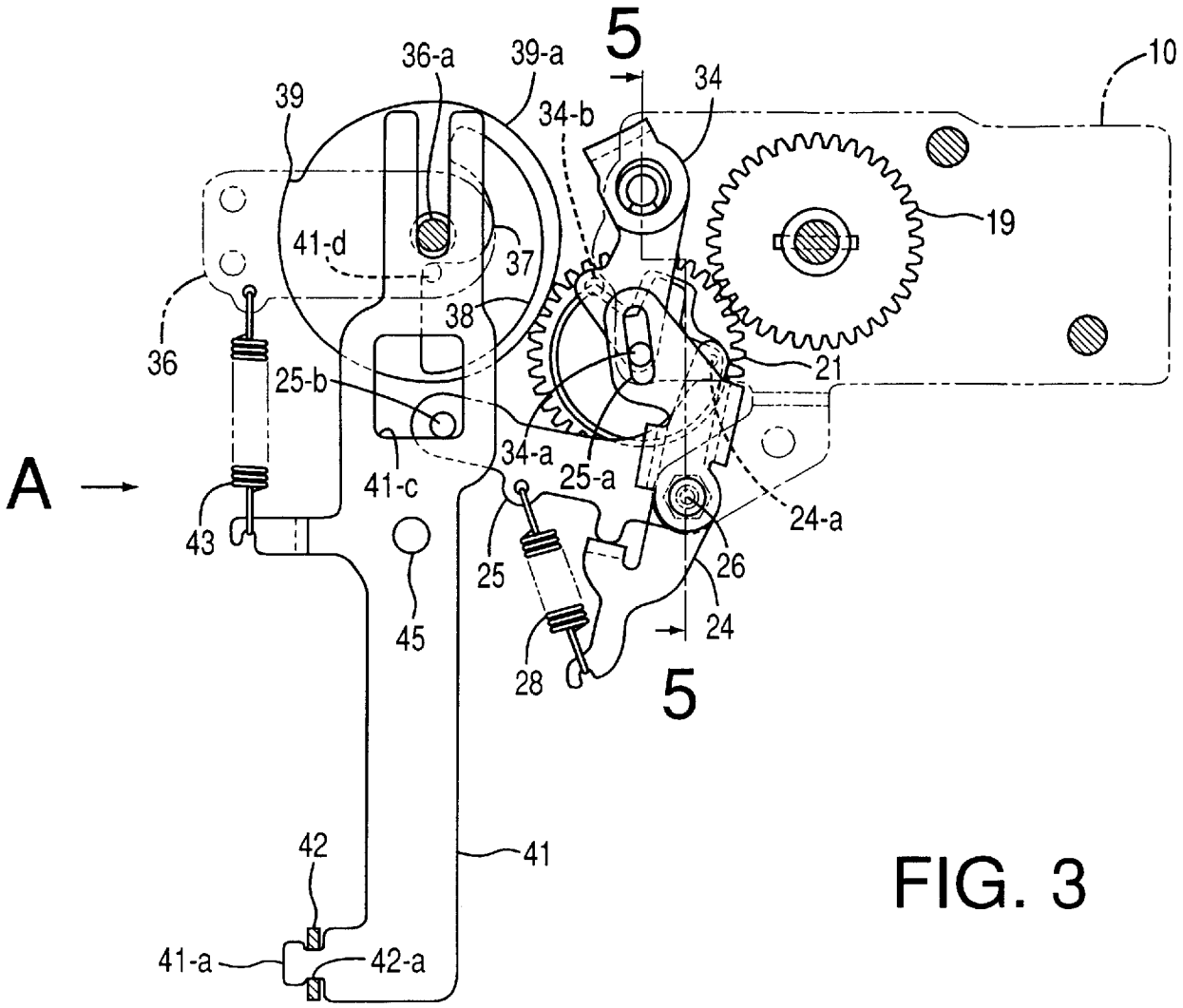
FIG. 3 is a view, taken in the direction of arrows 3—3 in FIG. 4, of the fabric feed control device associated with the feed regulator of the horizontal motion mechanism, when the feed control device is placed in a position for maximum forward feed distance.
Figure 4:
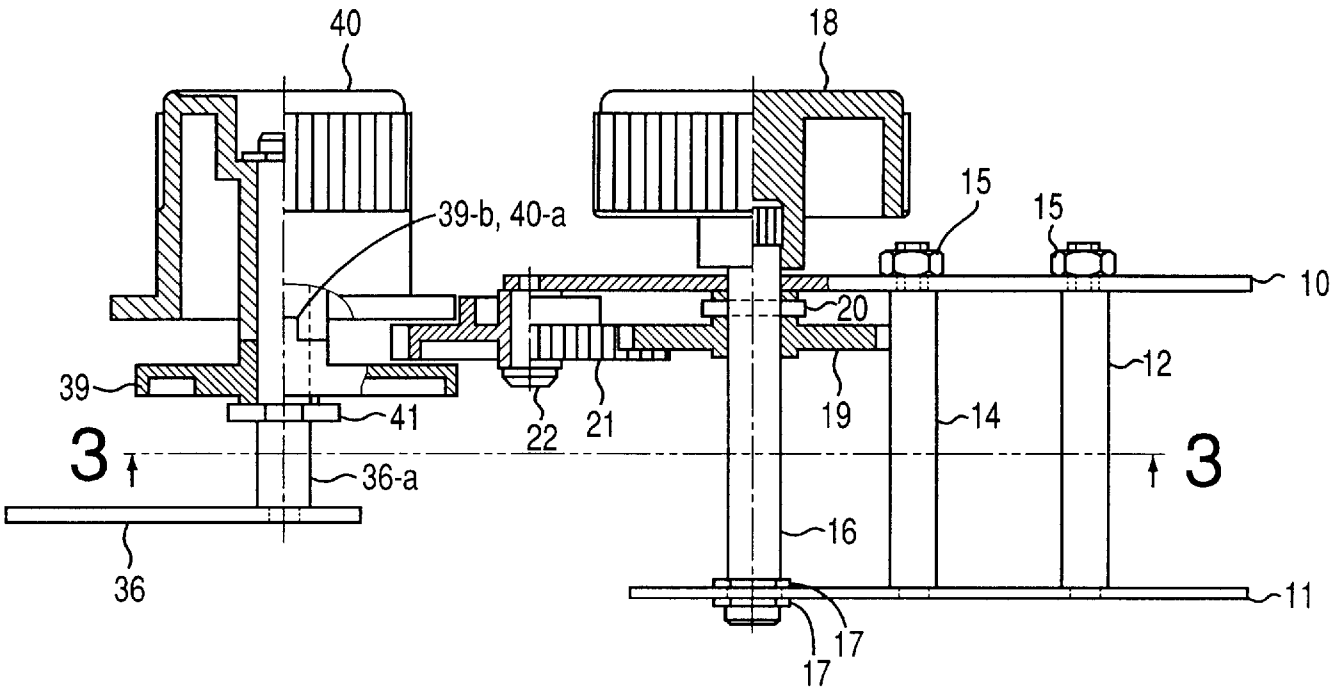
FIG. 4 is a view in cross section showing a portion of the fabric feed control device, which includes a pattern selector dial and a feed adjusting dial.

Referring to FIG. 3, there is shown the fabric feed control device when placed in its position for maximum forward feed distance of the feed dog 1. The fabric feed control device includes a frame 10 fixed to the body of the sewing machine. As shown in FIG. 4, the frame 10 is fixed to a frame 11 by two shafts 12 and 14, each of which is secured at one end thereof to the frame 11 and is fixed at the other, threaded end portion to the frame 10 by a nut 15. A pattern selector shaft 16 is rotatably supported by the frames 10, 11 such that an axial movement of the shaft 16 is prevented by retainer rings 17 which are fixed to the end portion of the shaft 16 on the side of the frame 11.

To the other end portion of the pattern selector shaft 16, there is fixed a pattern selector dial 18 as shown in FIG. 4. The pattern selector shaft 16 has a gear 19 fixed thereto by a pin 20, as also shown in FIG. 3, so that the gear 19 is rotated with the pattern selector dial 18. The gear 19 meshes with an externally toothed gear portion of an auxiliary cam 21 rotatable supported by a shaft 22 fixed to the frame 10, as shown in FIG. 4. The auxiliary cam 21 has a cam groove formed in a side surf ace thereof. The frame 10 also has a stepped screw 26 fixed thereto, as shown in FIG. 3. The screw 26 rotatably supports a first auxiliary feed plate 24 and a second auxiliary feed plate 25, which are biased toward each other by a tension spring 28 so that the first and second auxiliary feed plates 24, 25 are rotated as a unit.

Figure 5:
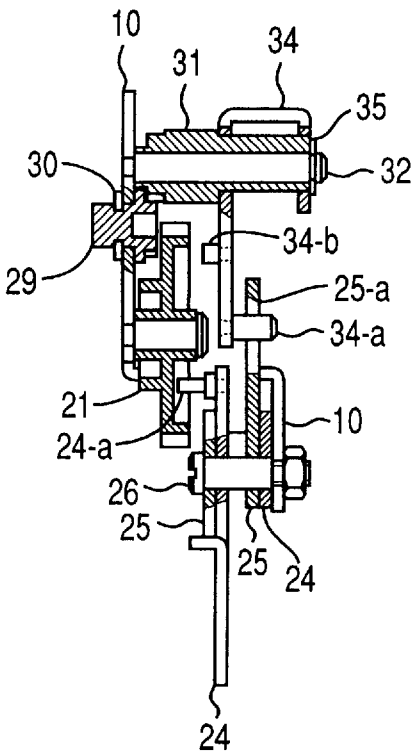
FIG. 5 is a view showing a portion of the fabric feed control device, which includes a buttonhole fine feed adjusting knob and a lever.

The first auxiliary feed plate 24 has a pin 24-*a* extending into the cam groove formed in the auxiliary cam 21, as shown in FIG. 5. The frame 10 rotatably supports a buttonhole fine feed adjusting knob 29 such that an axial movement of the knob 29 relative to the frame 10 is prevented by a retainer ring 30. The buttonhole fine feed adjusting knob 29 has an externally toothed gear portion which meshes with an externally toothed gear portion of a buttonhole fine feed adjusting member 31, which is rotatably supported by a shaft 32 fixed to the frame 10. The buttonhole fine feed adjusting member 31 has an eccentric shaft portion which rotatably engages a buttonhole fine feed adjusting lever 34 such that an axial movement of the lever 34 relative to the adjusting member 34 is prevented by a retainer ring 35. The adjusting lever 34 has a pin 34-*a* engaging a hole 25-*a* formed in the second auxiliary feed plate 25, as also shown in FIGS. 3 and 5.

Figure 6:
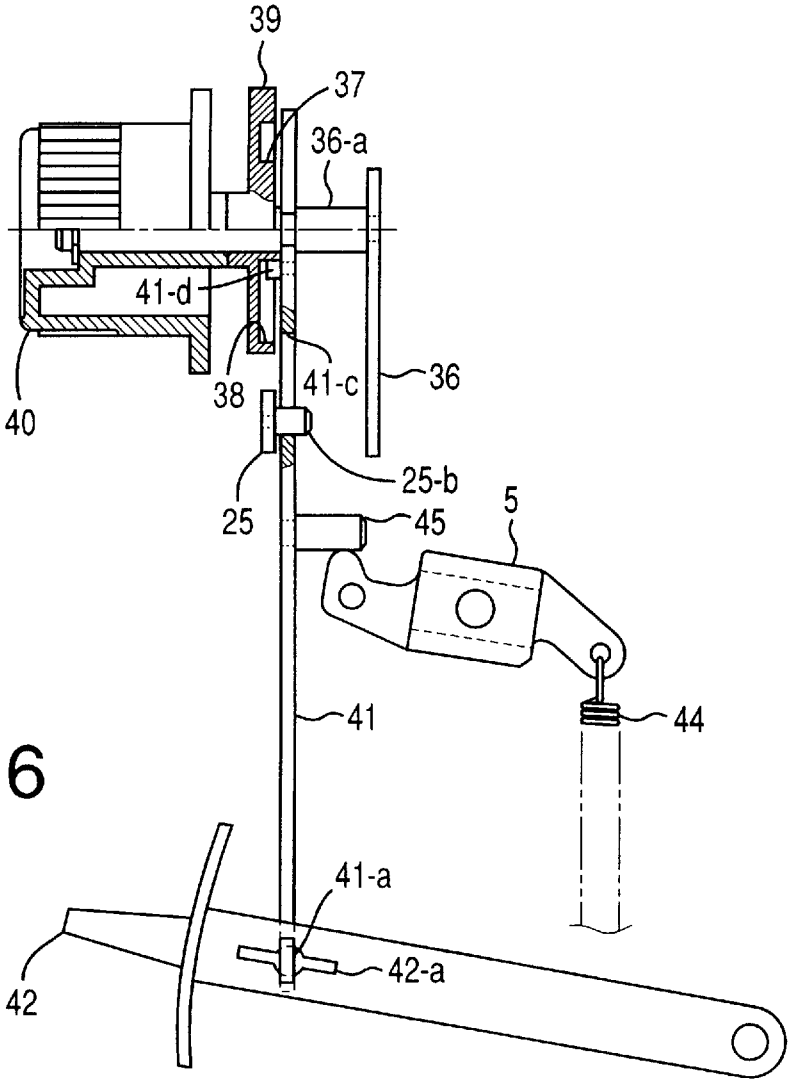
FIG. 6 is a view taken in the direction of arrow A in FIG. 3, showing a portion of the fabric feed control device at which the fabric feed control device is associated with the feed regulator of the fabric feeding device.

The fabric feed control device has a support frame 36 which is fixed to the body of the sewing machine and which has a support shaft 36-*a*, as shown in FIGS. 3, 4 and 6. The support shaft 36-*a* rotatably supports a feed control cam 39, which has a buttonhole reverse feed auxiliary cam 39-*a* formed at its radially outer portion, and a forward feed cam 37 and a reverse feed cam 38 that are formed at its radially inner portions such that the cam surfaces of the cams 37, 38 are opposed to each other. As described below, the forward feed cam 37 is used for controlling the forward feed distance of the feed dog 1 during a buttonhole stitching operation as well as an ordinary or straight stitching operation. The reverse feed cam 38 is used for controlling the reverse feed distance of the feed dog 1 during the straight stitching operation, while the buttonhole reverse feed auxiliary cam 39-*a* is used for controlling the reverse feed distance during the buttonhole stitching operation.

The support shaft 36-*a* also rotatably supports a feed adjusting dial 40 having a recessed portion 40-*a* which is fixedly fitted on an embossed portion 39-*b* of the feed control cam 39, as indicated in FIG. 4 so that the feed control cam 39 is rotated with the feed adjusting dial 40. The support shaft 36-*a* has an annular groove formed in its outer circumferential surface. This annular groove engages a bifurcated U-shaped upper end portion of a control plate 41. The control plate 41 is associated at its lower end portion 41-*a* with a hole 42-*a* formed in a forward-reverse switching lever 42, as shown in FIG. 6. This forward-reverse switching lever 42 is supported by the sewing machine body, pivotally about an axis which is remote from the hole 42-*a*. When the forward-reverse switching lever 42 is pivoted, the control plate 41 is vertically reciprocated with the bifurcated upper end portion being guided by the annular groove formed in the support shaft 36-*a*.

The control plate 41 has a pin 41-*d*, which is selectively brought into engagement with the forward feed cam 37 or the reverse feed cam 38 of the feed control cam 39. The control plate 41 is biased by a tension spring 43 in the upward direction so that the control plate 41 is normally placed in its upper forward-feed position in which the pin 41-*d* is held in engagement with the forward feed cam 37. The control plate 41 also has a hole 41-*c*, and the second auxiliary feed plate 25 has a pin 25-*b* extending into the hole 41-*c*, as shown in FIGS. 3 and 6, so that a rotary motion of the auxiliary cam 21 will cause a movement of the control plate 41 through the feed plates 24, 25.

As shown in FIG. 6, the feed regulator 5 of the horizontal motion mechanism 127 of the fabric feeding device is biased by a tension spring 44 fixed at one end thereof so that the feed regulator 5 is held in abutting contact at the other end with a shaft 45 fixed to the control plate 41. Thus, the biasing force of the tension spring 44 is transmitted to the control plate 41 through the feed regulator 5 and the shaft 45, so as to bias the control plate 41 in the upward direction. In other words, the tension spring 44 cooperates with the tension spring 43 to force the pin 41-*d* of the control plate 41 onto the forward feed cam 37.

The buttonhole reverse feed auxiliary cam 39-*a* of the feed control cam 39 and the pin 34-*b* of the buttonhole fine feed adjusting lever 34 are normally spaced apart from each other. When a buttonhole sewing operation is performed in the reverse direction, the forward-reverse switching lever 42 is pivoted downward by the operator against the biasing actions of the tension springs 43, 44, and the pattern selector dial 18 is rotated to a reverse-feed position. In this case, the pin 34-*b* is brought into contact with the buttonhole reverse feed auxiliary cam 39-*a*, by rotation of the auxiliary feed plates 24, 25, as described below, so that a rotary motion of the cam 39-*a* will cause a movement of the lever 34 through the pin 34-*b*, which causes the control plate 41 to be positioned by the cam 39-*a*.

When the sewing machine is operated to perform an ordinary sewing operation (e.g., straight stitching operation) other than an operation to form a buttonhole pattern or a super pattern on a work fabric, that is, when the work fabric is fed only in the forward direction in a sewing operation, for example, the feed adjusting dial 40 is rotated by the operator of the sewing machine, to an angular position corresponding to the desired forward feed distance of the feed dog 1. As a result, the forward feed cam 37 is rotated with the dial 40, and the control plate 41 is vertically moved with the forward feed cam 37 held in contact with the pin 41-*d* under the biasing force of the tension spring 43, so that the control plate 41 is positioned at a vertical position corresponding to the angular position of the dial 40 (forward feed cam 37). Accordingly, the feed regulator 5 of the horizontal motion mechanism 127 is pivoted by the shaft 45 of the control plate 41, to an angular position corresponding to the angular position of the dial 40, whereby the forward feed distance in the ordinary sewing operation is adjusted as desired by the machine operator. The fabric feed control device as shown in FIG. 3 is placed in the position for the maximum forward feed distance.

When a straight stitching operation or other ordinary sewing operation is performed with the fabric being fed in the reverse direction by the feed dog 1, the forward-reverse switching lever 42 is operated by the machine operator so as to pull down the control plate 41 against the biasing actions of the tension springs 43 and 44, to the lower reverse-feed position, so that the pin 41-*d*of the control plate 41 is brought into engagement with the reverse cam 38, to permit the control plate 41 to be vertically moved by a rotary motion of the reverse cam 38. When the feed adjusting dial 40 is rotated as needed, the feed regulator 5 is accordingly pivoted to adjust the feed distance in the reverse direction, in the same manner as described above with respect to the forward feed cam 37.

Figure 10:
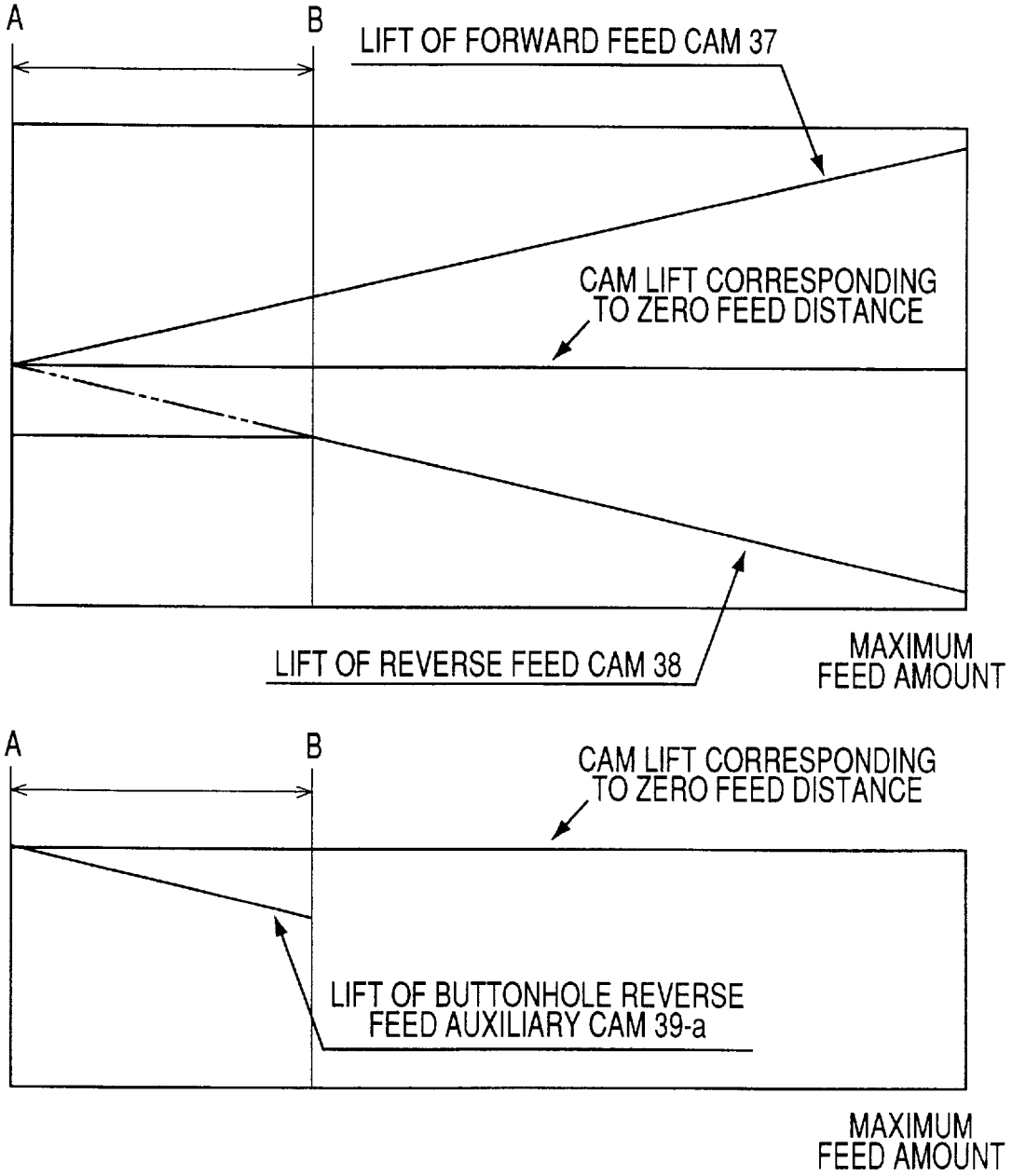
FIG. 10 is a graph indicating changes in lift amount of various cams used in the fabric feed control device.

When the feed adjusting dial 40 is set to a reverse feed distance smaller than a predetermined value, however, the feed regulator 5 is positioned so as to generate a predetermined reverse feed distance, irrespective of the angular position of the dial 40, because the reverse feed cam 38 is shaped so as to change a lift amount as indicated in solid line in the graph of FIG. 10, with an increase in the rotating angle of the feed adjusting dial 40. Described more particularly, the lift amount of the reverse feed cam 38 is held constant at a predetermined value while the angle of rotation of the dial 40 is smaller than a predetermined value corresponding to a relatively small feed distance. That is, the reverse feed cam 38 is shaped such that a constant-lift small-feed part corresponding to a small-feed range whose upper limit is a predetermined small value. This is not so with the forward feed cam 37 whose lift amount continuously increases from zero position of the dial 40. A significance of the constant lift amount of the reverse feed cam 37 will be described below.

The adjustment of the feed distance of the feed dog 1 for buttonhole sewing operations will be described.

When the work fabric is fed in the forward direction to form a right side part of a buttonhole pattern during the buttonhole sewing operation, for example, the feed adjusting dial 40 is rotated to establish a desired forward feed distance within a predetermined range, for example, between about 0.2 mm and about 1 mm. Then, the pattern selector dial 18 is rotated to a forward-feed position for sewing the right side part of the buttonhole pattern. A rotary motion of the dial 18 causes a rotary motion of the gear 19, which in turn causes a rotary motion of the auxiliary cam 21 to the position of FIG. 77. In this condition, the first and second auxiliary feed plates 24, 25 which are adapted to rotate as a unit are biased by the tension spring 43 in a clockwise direction as seen in FIG. 7, through the engagement of the pin 25-*b* of the plate 25 with the lower edge of the hole 41-*c* of the control plate 41.

Figure 7:
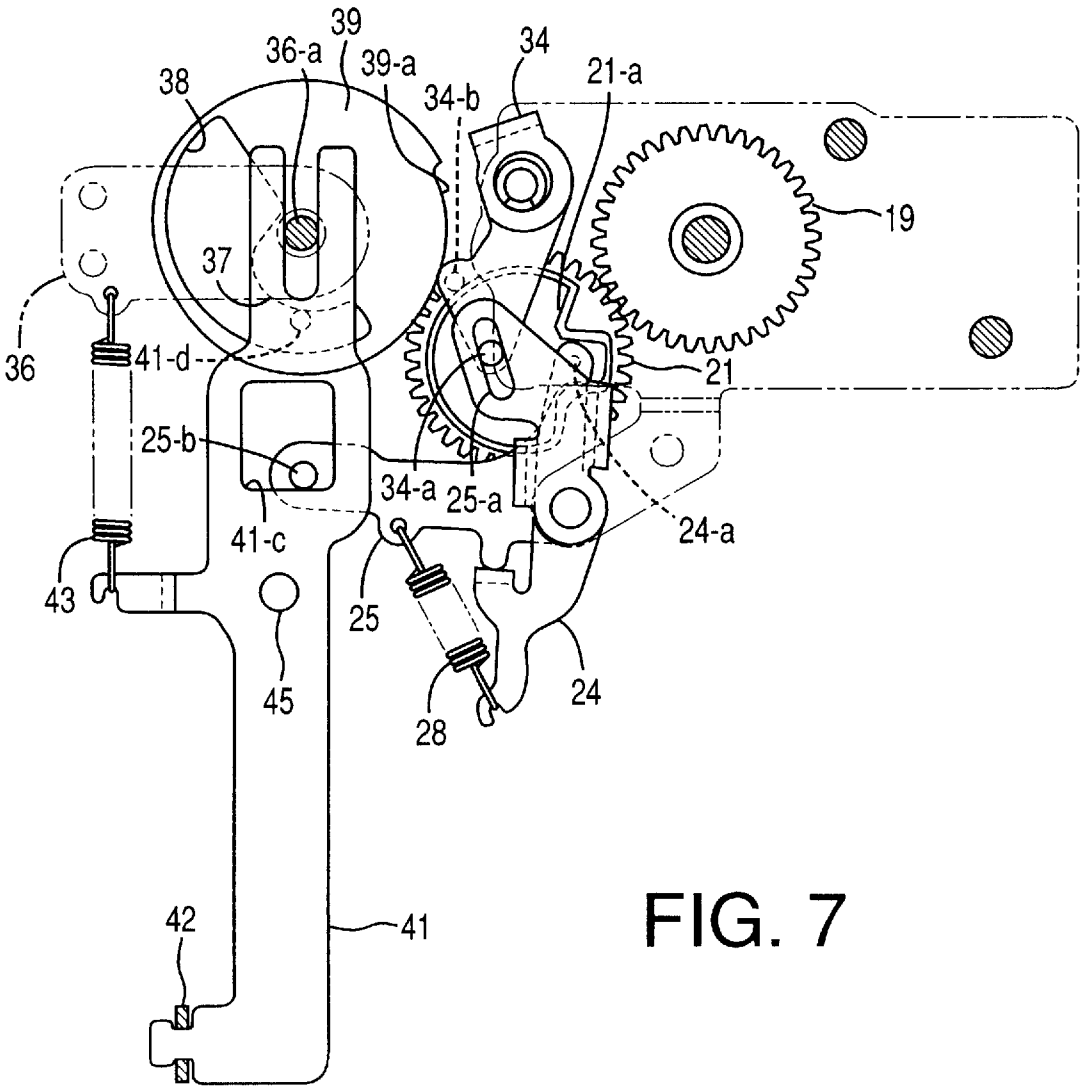
FIG. 7 is a view corresponding to that of FIG. 3, showing the fabric feed control device placed in a position for forward feeding of the fabric for sewing a buttonhole pattern.

However, a cam surface 21-*a* of the cam groove of the rotated auxiliary cam 21 does not contact the pin 24-*a* of the first auxiliary feed plate 24, as also indicated in FIG. 7, because the cam groove of the auxiliary cam 21 is shaped such that the pin 24-*a* of the first auxiliary feed plate 24 does not contact the cam surface 21-*a* of the cam groove even when the control plate 41 is lowered to its lowermost position by engagement of the pin 41-*d* with the forward feed cam 37. In this arrangement, the control plate 41 is precisely located at the vertical position corresponding to the angular position of the feed adjusting dial 40 (forward feed cam 37), that is, at the vertical position for the desired forward feed distance, without an influence of the rotary motion of the auxiliary cam 21 caused by the rotation of the pattern selector dial 18 to the position for the right side part of the buttonhole pattern. Accordingly, the feed regulator 5 is precisely positioned to establish the desired forward feed distance.

Further, the pin 34-*b* of the buttonhole fine feed adjusting lever 34 is held spaced apart from the buttonhole reverse feed auxiliary cam 39*a* of the feed control cam 39, under the biasing force of the tension spring 43, which is transmitted to the lever 34 through engagement of the pin 34-*a* of the lever 34 with the hole 25-*a* of the second auxiliary feed plate 25. Accordingly, an operation of the buttonhole fine feed adjusting knob 29 operatively connected to the lever 34 will not influence the forward feed distance in the forward buttonhole stitching operation.

When the work fabric is fed in the reverse direction to form a left side part of the buttonhole pattern, for example, the feed adjusting dial 40 is held at the angular position established for the forward feed distance, and the pattern selector dial 18 is rotated to the above-indicated reverse-feed position for sewing the left side part of the buttonhole pattern. A rotary motion of the dial 18 causes a rotary motion of the gear 19, which in turn causes a rotary motion of the auxiliary cam 21 to the position of FIG. 8. In this case, the the cam surface 21-*a* of the rotated auxiliary cam 21 contacts the pin 24-*a* of the first auxiliary feed plate 24, as shown in enlargement in FIG. 9, so as to rotate the plates 24, 25 in the counterclockwise direction as seen in FIG. 9, against the biasing force of the tension spring 43 which acts on the plates 24, 25 in the clockwise direction.

Figure 8:
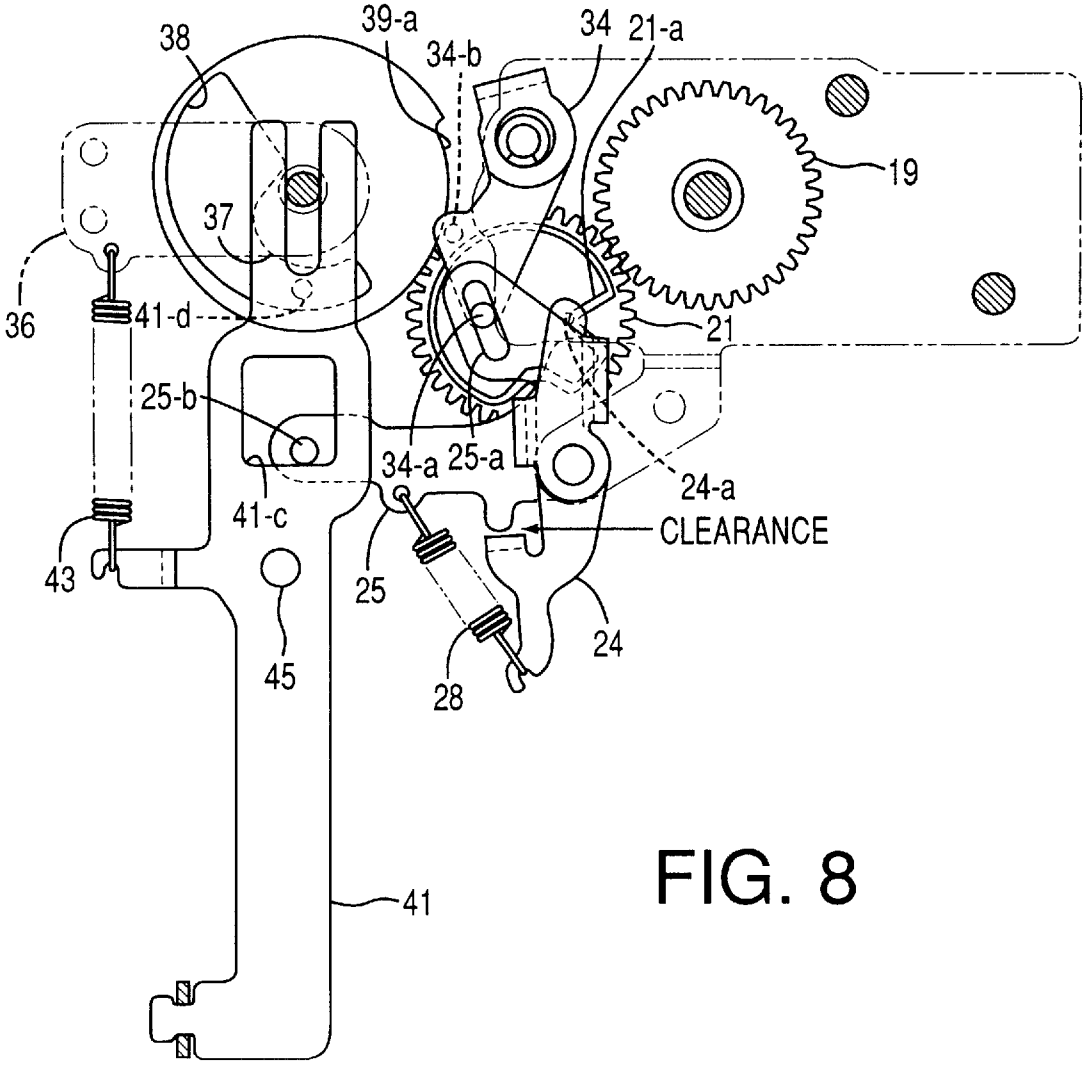
FIG. 8 is a view corresponding to that of FIG. 3, showing the fabric feed control device placed in a position for reverse feeding of the fabric for sewing a buttonhole pattern.
Figure 9:
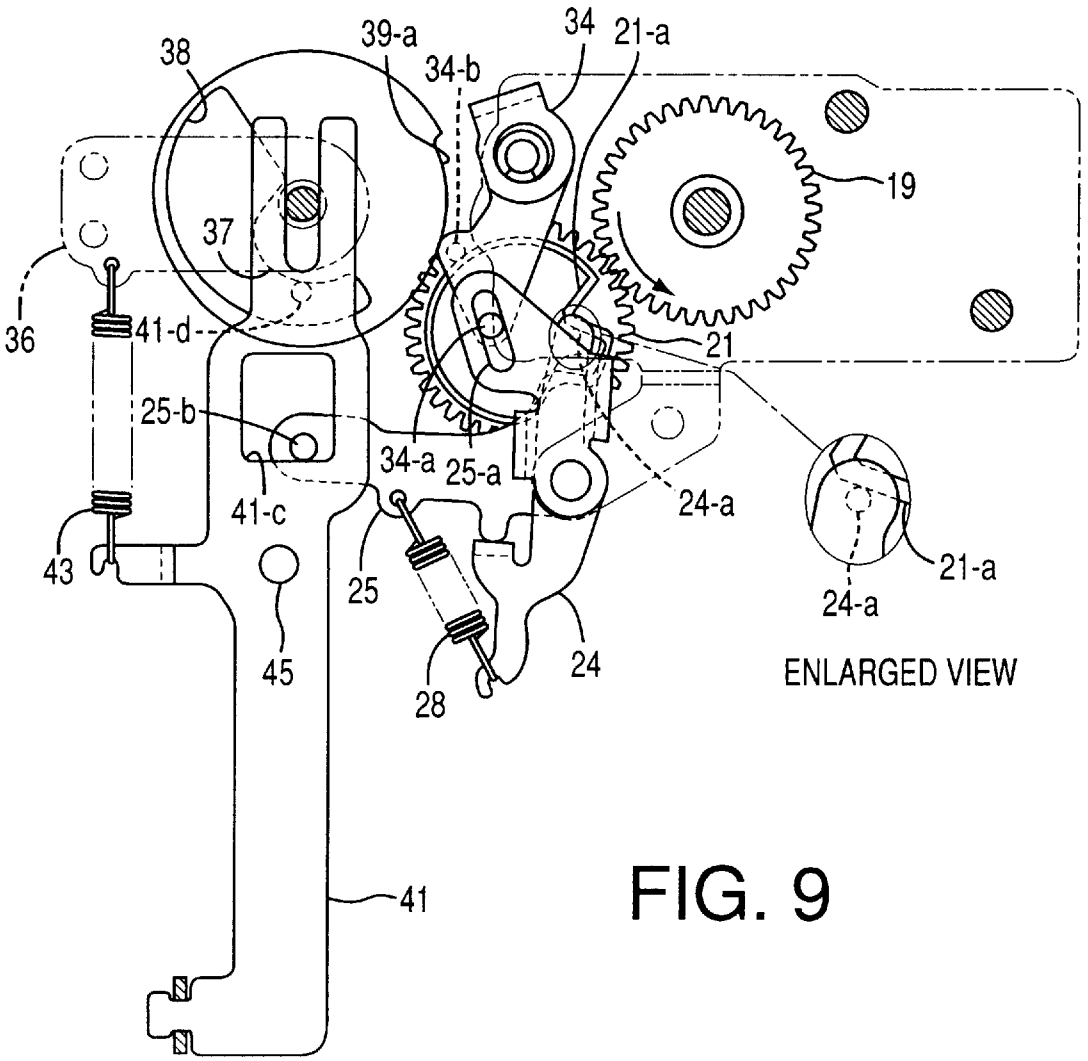
FIG. 9 is a view corresponding to that of FIG. 3, showing the fabric feed control device placed in a position intermediate between-the positions of FIGS. 7 and 8.

Since the biasing force of the tension spring 28 which biases the two plates 24, 25 toward each other is larger than that of the tension spring 43, the rotary motion of the auxiliary cam 21 after the contact of the cam surface 21-*a* with the pin 24-*a* will cause the plates 24, 25 to rotate in the counterclockwise direction against the biasing force of the tension spring 43, with the pin 25-*b* of the plate 25 forcing down the control plate 41 at its hole 41-*c*, to the position of FIG. 8. In this condition, the pin 41-*d* of the control plate 41 is spaced apart from the cam surface of the forward feed cam 37. The rotation of the feed plate 25 also causes rotation of the buttonhole fine feed adjusting lever 34 with its pin 34-*a* engaging the hole 25-*a* of the rotated second auxiliary feed plate 25, whereby the pin 34-*b* is brought into contact with the cam surface of the buttonhole reverse feed auxiliary cam 39-*a* of the feed control cam 39. Thus, the control plate 41 and the feed regulator 5 are positioned by the cam 39-*a* through the lever 34 and plate 25, so as to establish the reverse feed distance corresponding to the angular position of the feed auxiliary cam 39-*a* (angular position of the adjusting dial 40).

The cam groove of the auxiliary cam 21 has a lift large enough to force the pin 34-*b* of the lever 34 onto the cam surface of the buttonhole reverse feed auxiliary cam 39-*a*. Accordingly, even after the pin 34-*b* of the lever 34 has come into contact with the cam 39-*a*, the pin 24-*a* of the plate 24 is moved a further distance by the cam surface of the auxiliary cam 21, with a result of a further counterclockwise rotation of the plate 24 against the biasing force of the tension spring 28, whereby the tension spring 28 is elongated, and a clearance is created between the stop surfaces of the two plates 24, 25, as indicated in FIG. 8. This arrangement protects the related components against damage or deformation which would take place due to the rotation of the plate 24 after the contacting of the pin 34-*b* with the cam 39-*a*.

As indicated above, the lift amount of the reverse feed cam 38 is held constant at a predetermined value while the angle of rotation of the dial 40 from its zero position is smaller than a predetermined value corresponding to a relatively small feed distance, as indicated in the graphs of FIG. 10, which show changes of the lift amounts of the forward feed cam 37, reverse feed cam 38 and buttonhole reverse feed auxiliary cam 39-*a*. The lift amount of the forward feed cam 37 increases as the angle of rotation of the feed adjusting dial 40 increases from zero within a range A–B indicated in FIG. 10. However, the lift amount of the reverse feed cam 38 is held constant at the predetermined value within the small-feed range, namely, within the angular range A–B of the dial 40. Within this angular range A–B, the cam lift of the buttonhole reverse feed auxiliary cam 39-*a* changes, as also indicated in FIG. 10.

It will be understood from the above description that the feed distance of the feed dog 1 in the forward stitching operation to form the right side part of a buttonhole is established or adjusted by the forward feed cam 37, while the feed distance in the reverse stitching operation to form the left side part of the buttonhole pattern is established or adjusted by the buttonhole reverse feed auxiliary cam 39-*a*. In principle or theoretically, the work fabric can be fed by substantially the same distance for each stitch, with the feed adjusting dial 40 held in the same angular position in the forward and reverse stitching operations, whereby the buttonhole pattern can be sewn with a high degree of right and left symmetry in shape.

Where the work fabric is a stretch fabric having a comparatively high degree of elasticity, the actual forward and reverse feed distances in the respective forward and reverse stitching operations to sew the respective right and left side parts of the buttonhole pattern may differ from each other. If the feed adjusting dial 40 is set for optimizing the forward feed distance, for example, the reverse feed distance may deviate from the optimum value. Although the reverse feed distance. can be reduced with respect to the forward feed distance, the reverse feed distance could not be suitably increased with respect to the forward feed distance if the lift amount of the reverse feed cam 38 increases from zero within the range A–B as indicated by two-dot chain line in FIG. 10, for the reason which will be understood from the following explanation.

If the feed adjusting dial 40 is rotated to increase the reverse feed distance larger than the value corresponding to the upper limit of the range A–B, the rotation of the dial 40 would not increase the reverse feed distance to the value corresponding to the angular position of the rotated dial 40, if the reverse feed cam 38 is shaped so as to increase its lift amount from zero within the range A–B. In view of this inconvenience, the reverse feed cam 38 is shaped such that the lift amount is held constant within the angular range A–B of the dial 40, and the buttonhole reverse feed auxiliary cam 39-*a* is shaped such that the lift a mount changes within the range A–B as indicated in FIG. 10, so that a fine adjustment of the reverse feed distance can be accomplished by an appropriate angle of rotation of the cam 39-*a* by rotating the dial 40 for the reverse buttonhole stitching operation.

Figure 11:
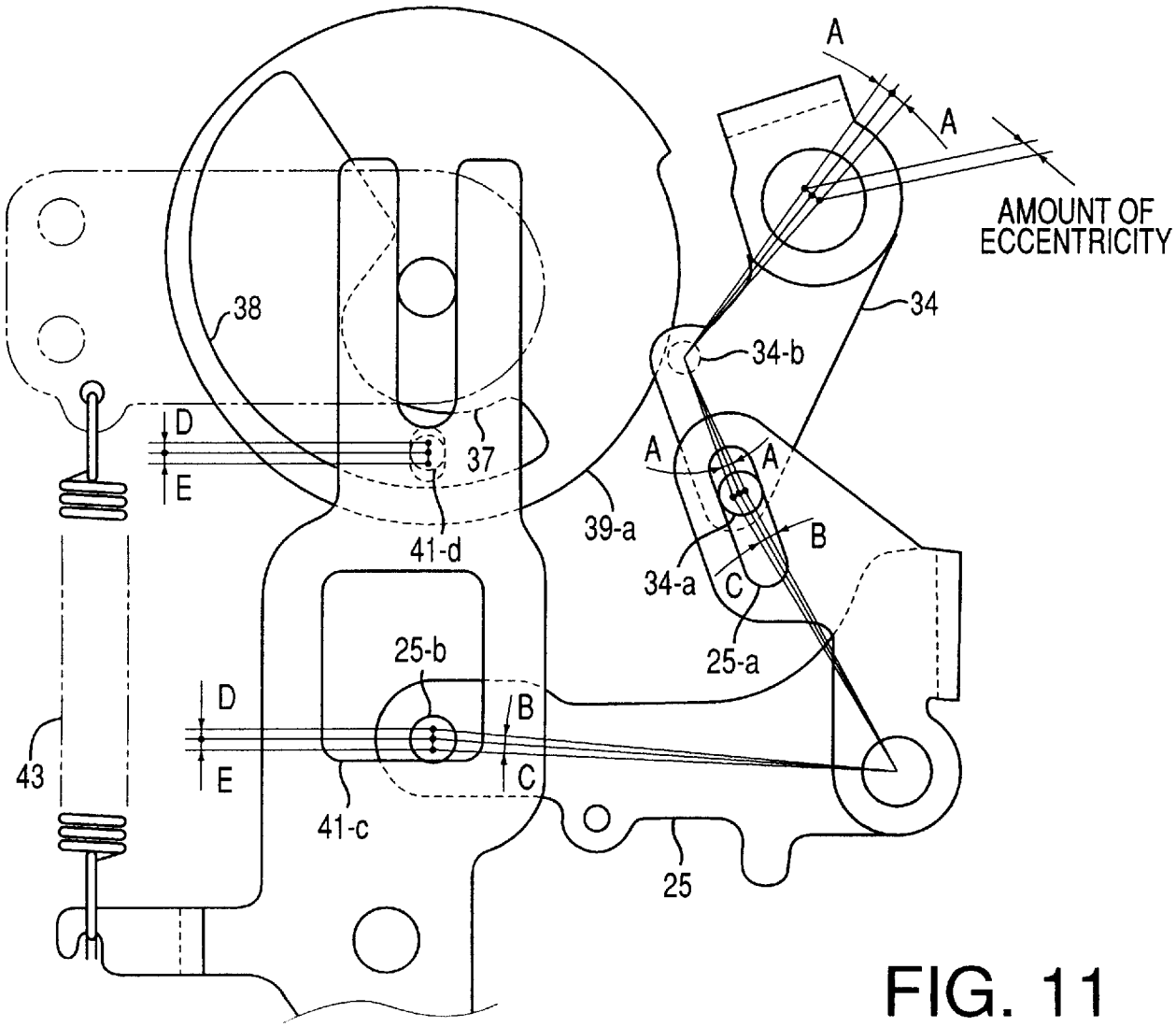
FIG. 11 is a view for explaining adjustment for fine adjustment of the reverse feed distance for sewing a buttonhole pattern.

When it is desired to make fine adjustment of the reverse feed distance with respect to the optimized forward feed distance, the buttonhole fine feed adjusting knob 29 shown in FIG. 5 is rotated by a suitable angle in the clockwise or counterclockwise direction. As a result, the buttonhole fine feed adjusting member 31 whose gear portion meshes with the gear portion of the knob 29 is rotated, so that the buttonhole fine feed adjusting lever 34 rotatably engaging the eccentric shaft portion of the member 31 is moved in the direction perpendicular to the axis of the member 31, by a distance corresponding to the angle of rotation of the knob 29, namely, by a distance corresponding to the amount of displacement of the eccentric shaft portion of the member 31. As a result, the buttonhole fine feed adjusting lever 34 is pivoted about the pin 34-*b* in pressing contact with the cam surface of the buttonhole reverse feed auxiliary cam 39-*a*, by an angle corresponding to the amount of displacement of the above-indicated eccentric shaft portion, as indicated in FIG. 11. Consequently, the auxiliary feed plates 24, 25 are rotated through the engagement between the pin 34-*a* and the hole 25-*a*, so that the control plate 41 is moved up or down by a small distance, and the feed regulator 5 is accordingly pivoted in the corresponding direction. In FIG. 11, "D " represents the maximum distance of downward movement of the control plate 41 to reduce the reverse feed distance, while "E" represents the maximum distance of upward movement of the control plate 41 to increase the reverse feed distance.

Figure 12:
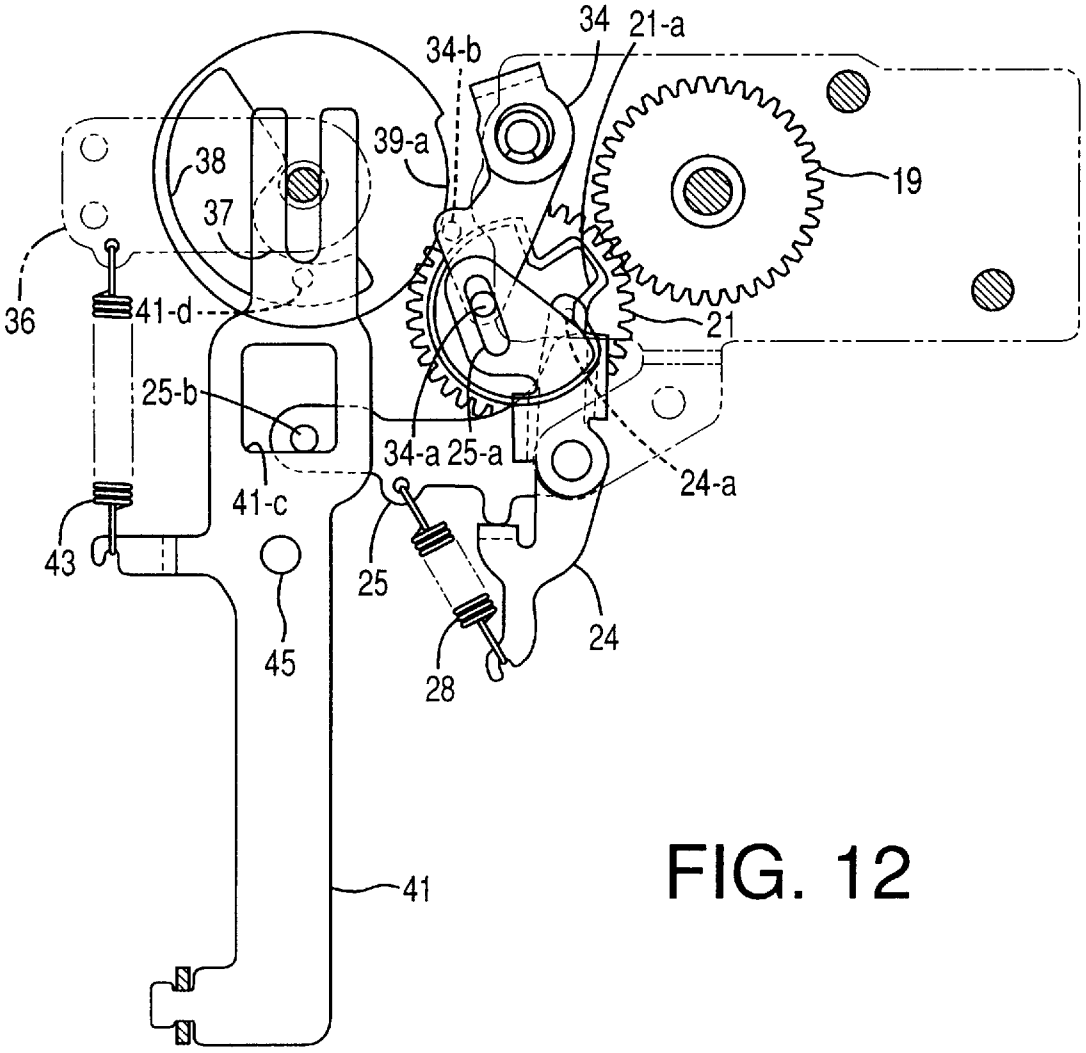
FIG. 12 is a view corresponding to that of FIG. 3, showing the fabric feed control device placed in a position for sewing a bar tack portion of a buttonhole pattern.

When a bar tack part of the buttonhole pattern is stitched, the pattern selector dial 18 is operated to a bar-tack position for stitching the bar tack part of the buttonhole pattern, while the feed adjusting dial 40 is held in the angular position established for the forward feed distance. As a result, the auxiliary cam 21 is rotated to the position of FIG. 12. The rotation of the auxiliary cam 21 provides the same result as in the case where the dial 18 is operated to the reverse-feed position for the left side part of the buttonhole pattern. Namely, the rotary motion of the auxiliary cam 21 after the contact of the cam surface 21-*a* with the pin 24-*a* will cause the plates 24, 25 to rotate in the counterclockwise direction against the biasing force of the tension spring 43, whereby the control plate 41 is forced down to the position of FIG. 12. In this condition, the cam surface of the forward feed cam 37 is spaced apart from the pin 41-*d*.

At the same time, the rotation of the second auxiliary feed plate 25 whose hole 25-*a* engages the pin 34-*a* of the buttonhole fine feed adjusting lever 34 will cause a rotary motion of the lever 34 so that the pin 34-*b* is moved toward the cam surface of the buttonhole reverse feed auxiliary cam 39-*a*. However, the pin 34-*b* is not brought into contact with the auxiliary cam 39-*a*. The vertical position of the control plate 41 in the bar tack stitching operation in which the fabric is not fed is established or determined not by the forward feed cam 37 or the buttonhole reverse feed auxiliary cam 39-*a*, but is determined by the lift of the auxiliary cam 21. The present fabric feed control device in arranged such that the bar tack stitching operation can be effected with the feed adjusting dial 40 kept in the position established for the forward or reverse feed distance. In other words, the dial 40 need not be positioned for zeroing the feed distance, even in the bar tack stitching operation. For this reason, the auxiliary cam 21 is used to position the control plate 41 during the bar tack stitching operation. If the fabric feed control device was arranged to require the dial 40 to be positioned for zeroing the feed distance in the bar tack stitching operation, the fabric feed control device may be adapted such that the pin 34-*b* of the lever 34 is brought into contact with the buttonhole reverse feed auxiliary cam 39-*a* when the pattern selector dial 18 is operated to the position for the bar tack part of the buttonhole pattern.

It will be understood that the fabric feed control device constructed as described above according to the present embodiment of the invention does not use three cam members for the right and left side parts and back tack part of a buttonhole pattern, and does not require a cam follower device which is movable in the direction in which such three cam members are spaced from each other. It will also be understood that the present fabric feed control device not only permits adjustments of the forward and reverse feed distances for stitching a super pattern or a buttonhole pattern, but also permits a fine adjustment of the reverse feed distance to establish an optimum balance between the forward and reverse feed distances, which assures symmetrical configuration of the buttonhole pattern sewn by the sewing machine.

Referring next to FIGS. 13–22, there will be described a fabric feed control device according to a second embodiment of this invention, which is adapted to permit stitching operations to form super patterns, and also permit fine adjustment of the forward and reverse feed distances in such super pattern stitching operations, as well as in buttonhole stitching operations and ordinary or straight stitching operations.

Figure 13:
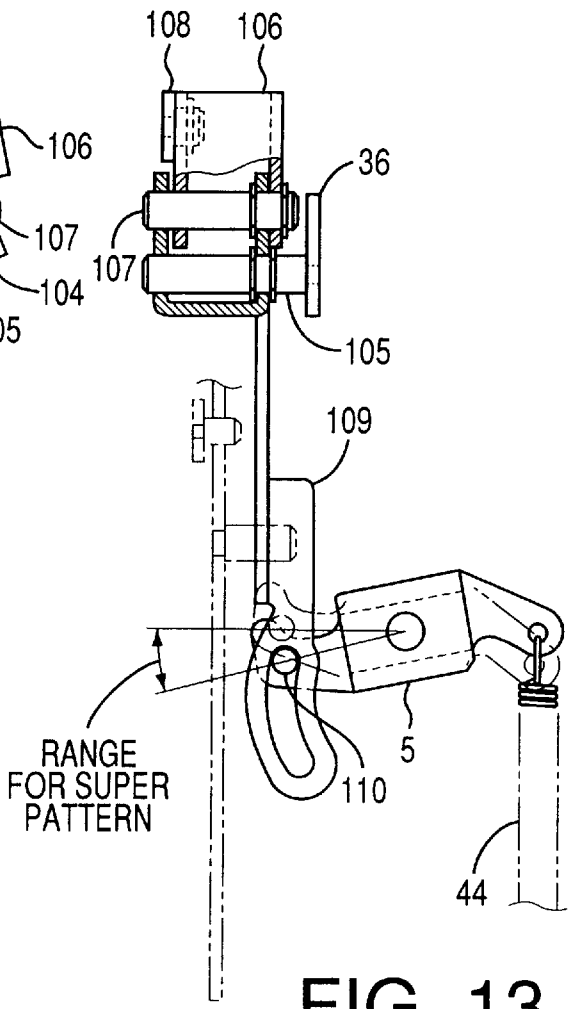
FIG. 13 is a view showing a super pattern feed cam and the related mechanism of a fabric feed control device constructed according to a second embodiment of the invention, which fabric feed control device is associated with the feed regulator of the fabric feeding device.
Figure 14:
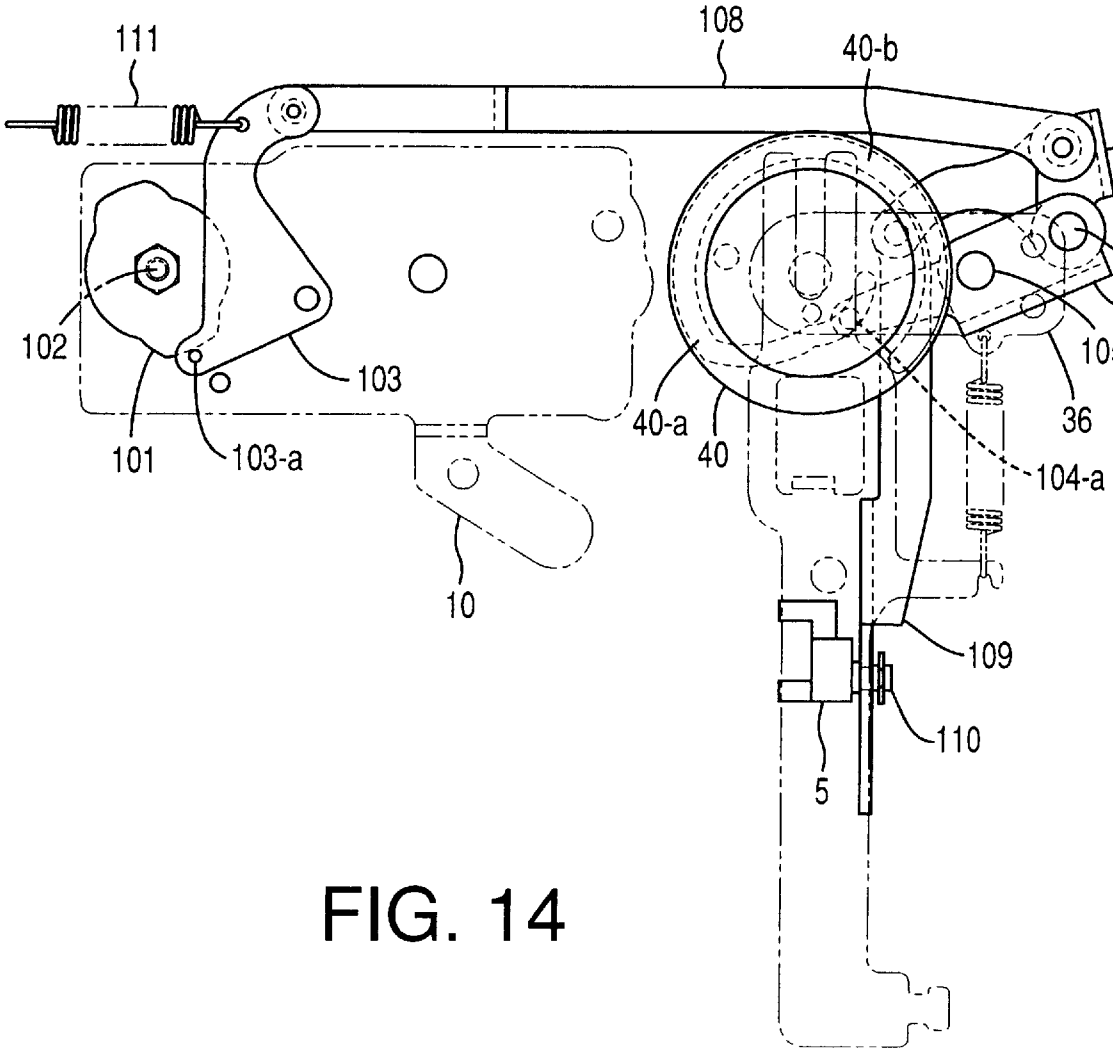
FIG. 14 is a view corresponding to that of FIG. 3, showing the mechanism of FIG. 13 when placed in a super pattern position.
Figure 15:
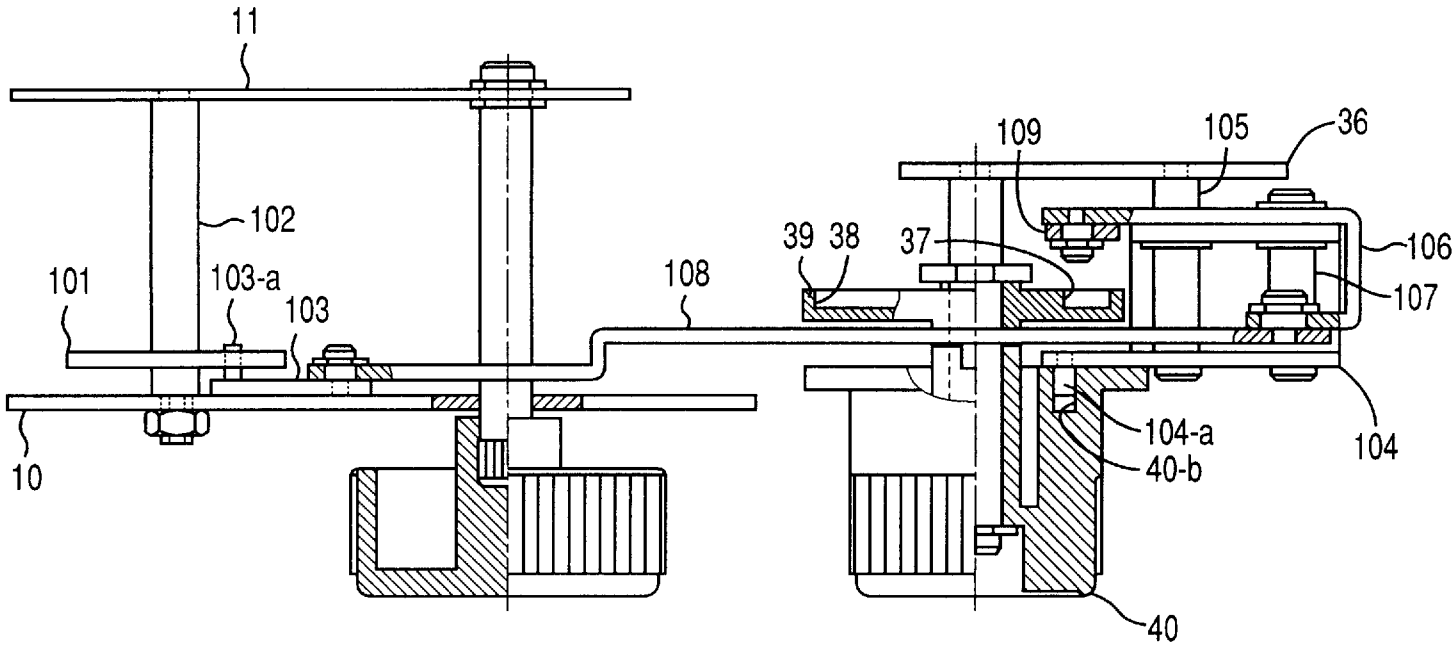
FIG. 15 is a cross sectional view corresponding to that of FIG. 4, showing the mechanism of FIG. 13.

Reference is first made to FIGS. 13–15, the present fabric feed control device includes a super pattern feed cam 101, a cam follower 103, a holder 104, a lever 106, and a control lever 109. The super pattern feed cam 101 is rotatable supported by a shaft 102 secured to the frames 10 and 11 of the sewing machine. This feed cam 101 is kept rotated by a drive shaft (not shown). The cam follower 103 having a follower pin 103-*a* located adjacent to the periphery of the feed cam 101 is rotatably supported by the frame 10. The holder 104 is rotatably supported by a shaft 105 secured to the support frame 36 of the sewing machine, and has a pin 104-*a* which engages a cam groove 40-*b* formed in the feed adjusting dial 40, as shown in FIGS. 14 and 15. The shape of the cam groove 40-*b* is shown in detail in FIG. 18, and the relationship between the cam groove 40-*b* and the cams 37, 38 is indicated in FIG. 19 wherein the cam groove 40-*b* is shown in two-dot chain line. The lever 106 is rotatably supported by a shaft 107 secured to the holder 104, and is connected by a connector lever 108 to the cam follower 103. The control lever 109 is connected at one end thereof to the lever 106, and at the other end to the shaft 110 fixed to the feed regulator 5 of the horizontal motion mechanism 127.

A tension spring 111 is connected at one end to the cam follower 103 and at the other end to a stationary member of the sewing machine, so that the cam follower 103 is biased by the tension spring 111 in a direction that causes the follower pin 103-*a* to move away from the cam surface of the feed cam 101.

The cam groove 40-*b* has a super pattern position A at which the pin 104-*a* of the holder 104 is located when a super pattern is sewn. To sew the super pattern, the dial 40 is rotated until the pin 104-*a* is located at the super pattern position A. Thus, the dial 40 rather than the pattern selector dial 18 is operated when it is desired to sew the super pattern. The fabric feed control device as shown in FIGS. 13 and 14 is placed in this super pattern position A. The cam groove 40-*b* further has a maximum feed position C at which the forward feed amount or distance is the largest. That is, when the pin 104-*a* is located at the maximum feed position C, the forward feed distance is the largest. The cam groove 40-*b* has an end position B located on one side of the super pattern position A which is remote from the maximum feed position C. The angular distance between the positions A and B is equal to the angular distance between the positions A and C. The positions B and C define a fine feed adjustment range in which the feed distance for sewing a super pattern can be finely adjusted. Namely, the centerline of the portion of the cam groove 40-*b* between the positions B and C is slightly offset with respect to a circular arc having a center at the axis of rotation of the dial 40, such that the radial distance between the axis of rotation and the centerline increases from the position B toward the maximum feed position C. At the position B, the reverse feed distance is the largest.

Figure 18:
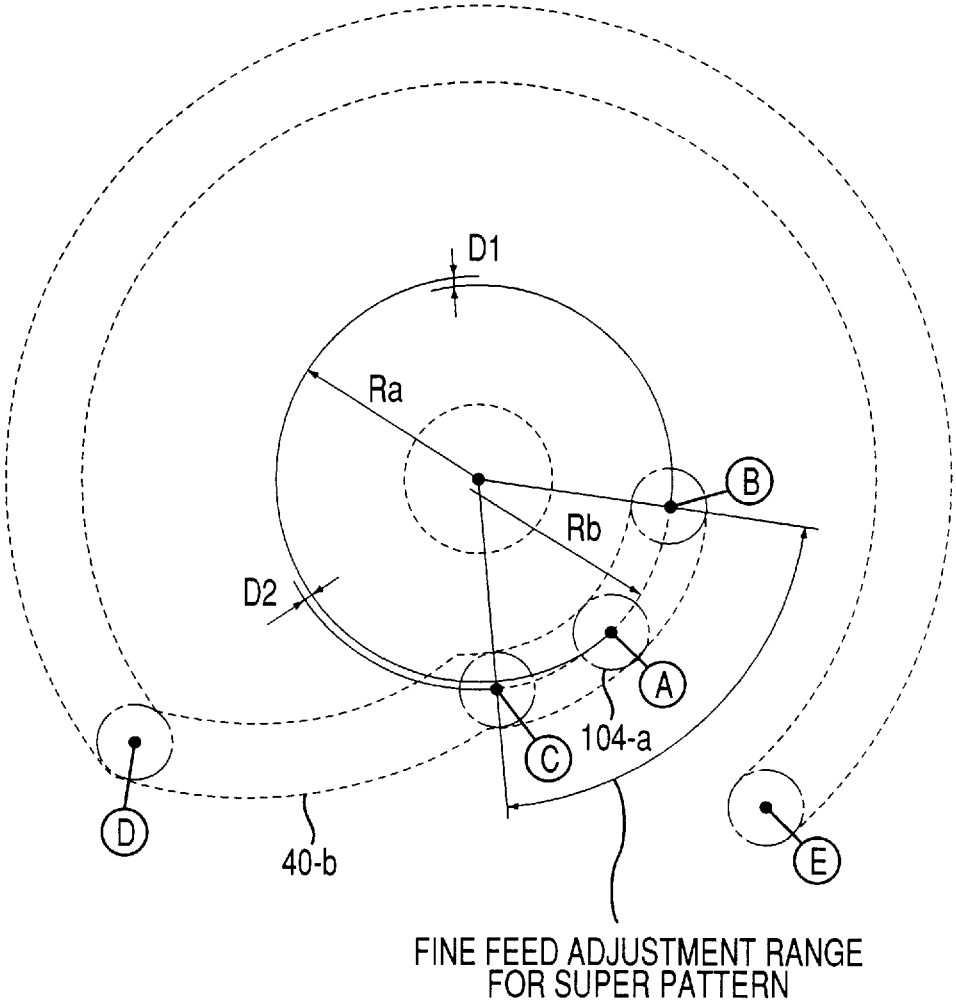
FIG. 18 is a view showing an angular range of the feed adjusting dial within which fine adjustment of the feed distance for sewing a super pattern is possible.
Figure 19:
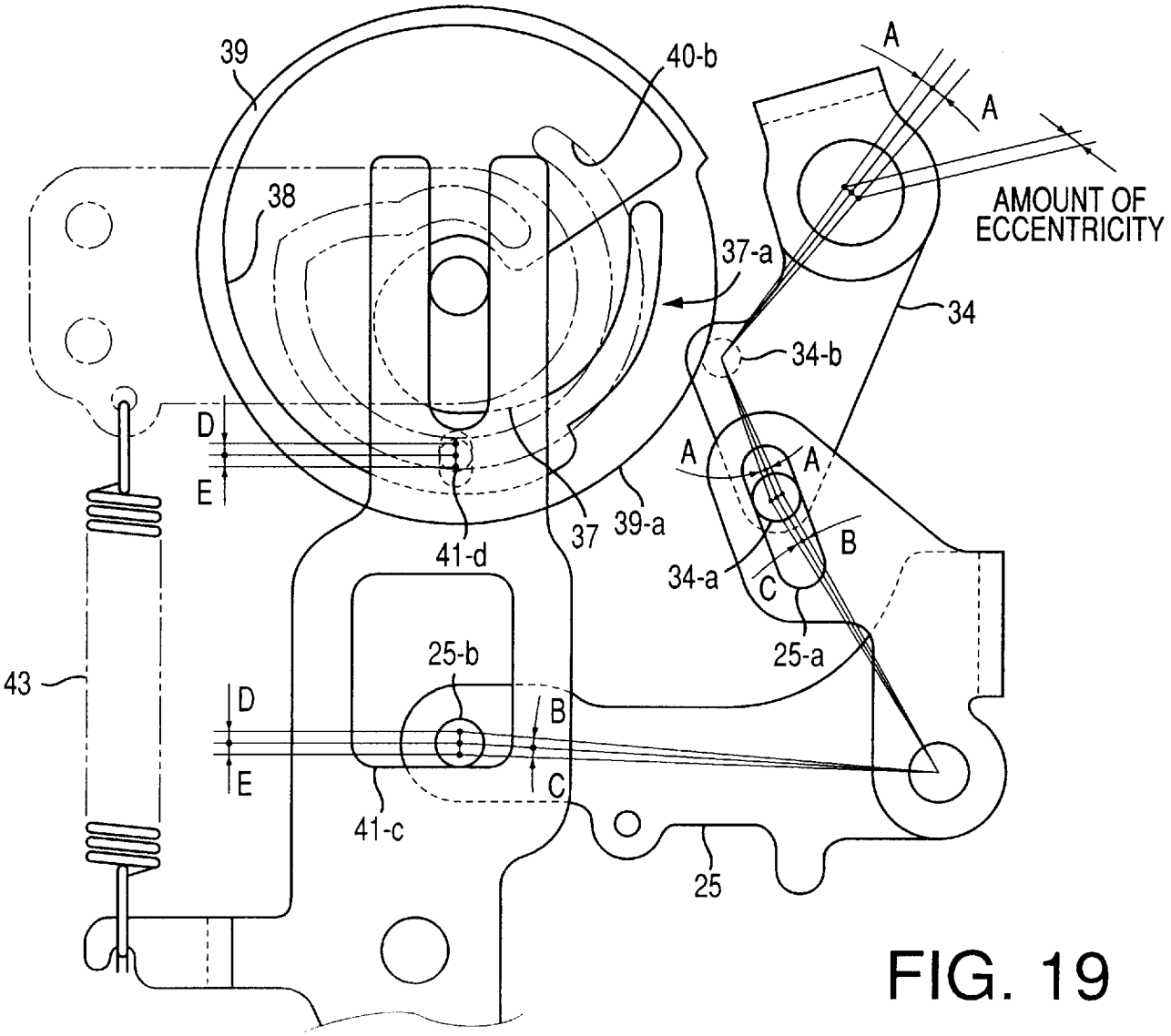
FIG. 19 is a view corresponding to that of FIG. 11, showing feed control cams and a positional relationship thereof with a cam groove for fine adjustment of the feed distance for the super pattern.

The cam groove 40-*b* also has an end position E opposite to the end position B, and an intermediate position D, as also indicated in FIG. 18. The centerline of the portion of the cam groove 40-*b* between the positions D and E follows a circular arc having a center at the axis of rotation of the dial 40. When a sewing operation other than the operation to sew a super pattern, the dial 40 is rotated until the pin 104-*a* of the holder 104 is located within the portion of the cam groove 40-*b* between the positions D and E, as described above.

The biasing force of the tension spring 111 is selected to be considerably smaller than that of the tension spring 44 biasing the feed regulator 5 (FIG. 13), so that when the super pattern position of the dial 40 (position A indicated in FIG. 18) is established as shown in FIG. 14, the follower pin 103-*a* of the cam follower 103 is held in contact with the cam surface of the super pattern feed cam 101 under the biasing action of the tension spring 44, whereby the work fabric is fed so as to perform a stitching operation to form the desired super pattern, according to the cam lift of the super pattern feed cam 101 which is transmitted to the feed dog 1 through the control lever 108 and the feed regulator 5 of the horizontal motion mechanism 127.

To make fine adjustment of the forward or reverse feed distance for a sewing operation to form a super pattern, the dial 40 is rotated from the nominal super pattern position A within the angular range between the positions B and C. With the dial 40 being rotated within this angular range B–C, the axis of the shaft 107 about which the lever 106 is pivoted is displaced. The nominal super pattern position A is a position for a standard position for sewing a super pattern. A rotary motion of the dial 40 within this range B–C of the cam groove 40-*a* will cause the holder 104 to be pivoted about the shaft 105, as indicated at E1 and E2 in FIG. 21, resulting in a movement of the shaft 107 as indicated at F1 and F2 in FIG. 21, so that the control lever 109 engaging the pin 110 of the feed regulator 5 is moved, as indicated at F1, F2 in FIG. 22, so that a balance between the forward and reverse feed distances can be intricately adjusted by rotating the dial 40 within the range between the positions B and C indicated in FIG. 18.

Figure 16:
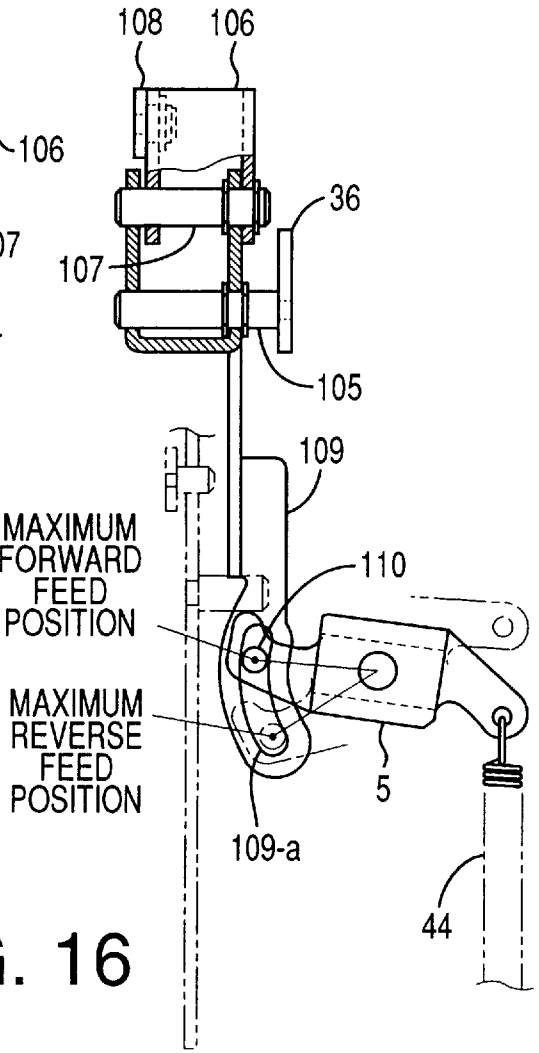
FIGS. 16 and 17 are views corresponding to those of FIGS. 13 and 14, respectively, showing the fabric feed control device placed in a position for a sewing operation other than an operation to sew a super pattern.
Figure 17:
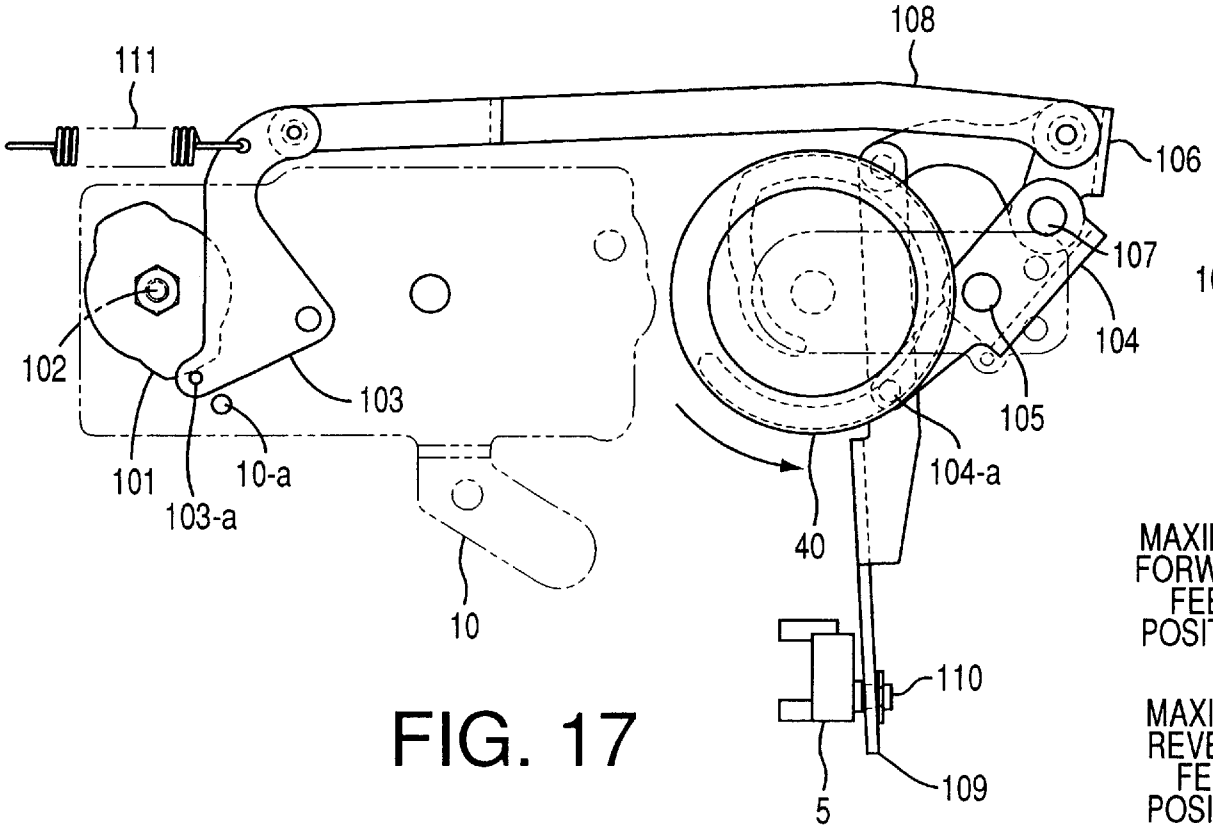

When a sewing operation other than the operation to sew a super pattern is performed, the dial 40 is placed in a position in which the pin 104-*a* is located at a position between the intermediate and end positions D and E, for instance, in the position E as shown in FIGS. 16 and 17. While only the portion of the cam groove 40-*b* between the positions B and C is required for the fine adjustment of the forward and reverse feed distances relative to each other for sewing a super pattern, the portion between the positions C and E is required to permit the feed adjustment by the feed control cam 39 for the other stitching operations such as the buttonhole stitching operations and straight stitching operations. In this respect, it is noted that the feed control cam 39 having the forward and reverse feed cams 37, 38 and the buttonhole reverse feed auxiliary cam 39-*a* is rotated with the feed adjusting dial 40 which has the cam groove 40-*b* for the fine adjustment of the feed distance for the super pattern.

Figure 20:
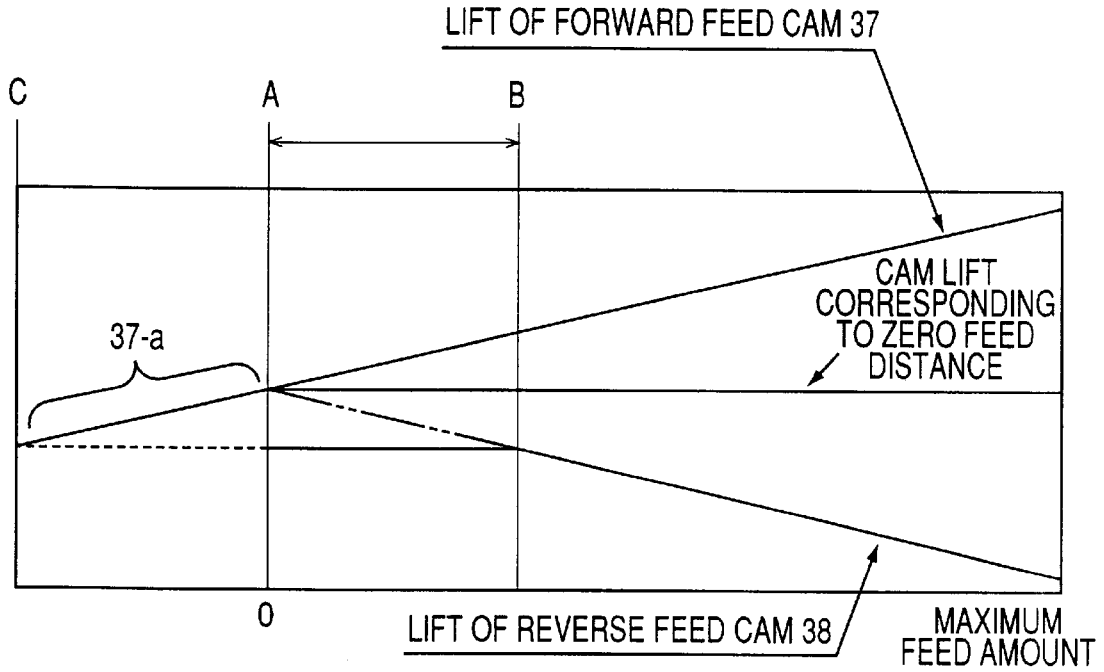
FIG. 20 is a graph showing lift amounts of the feed control cams shown in FIG. 19.
Figure 20:
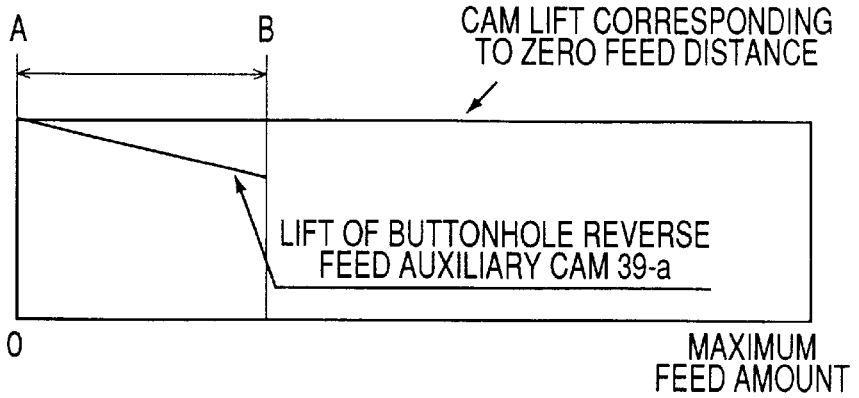
Figure 22:
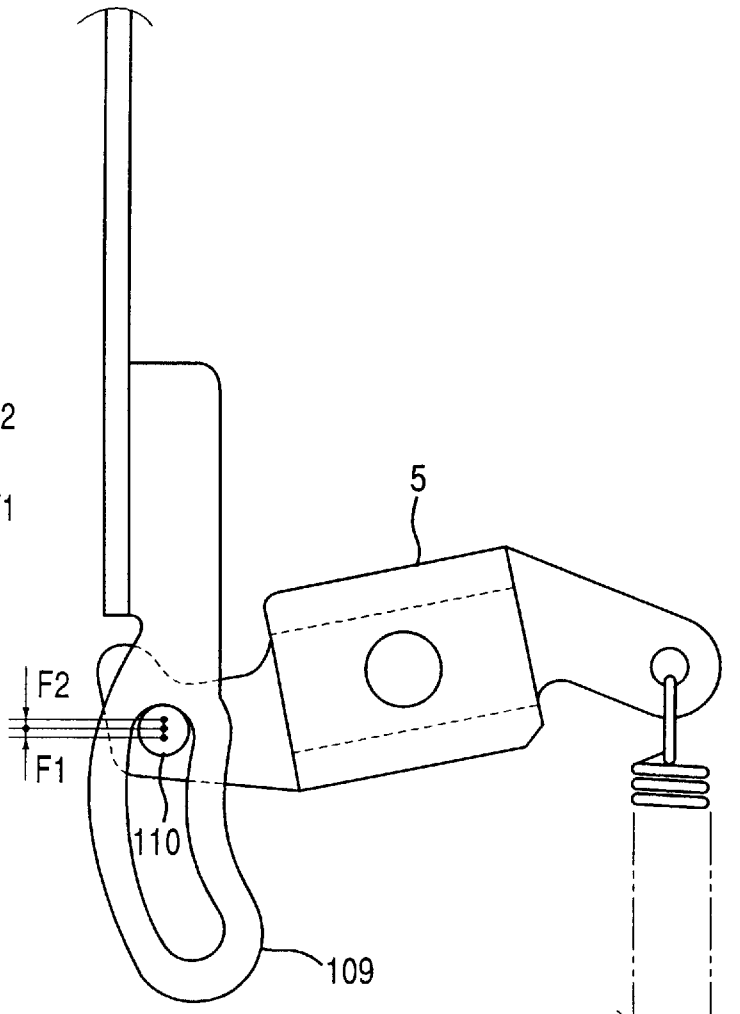
FIGS. 21 and 22 are views for explaining an operation of the fabric feed control device for the fine adjustment of the feed distance for sewing a super pattern.
Figure 21:
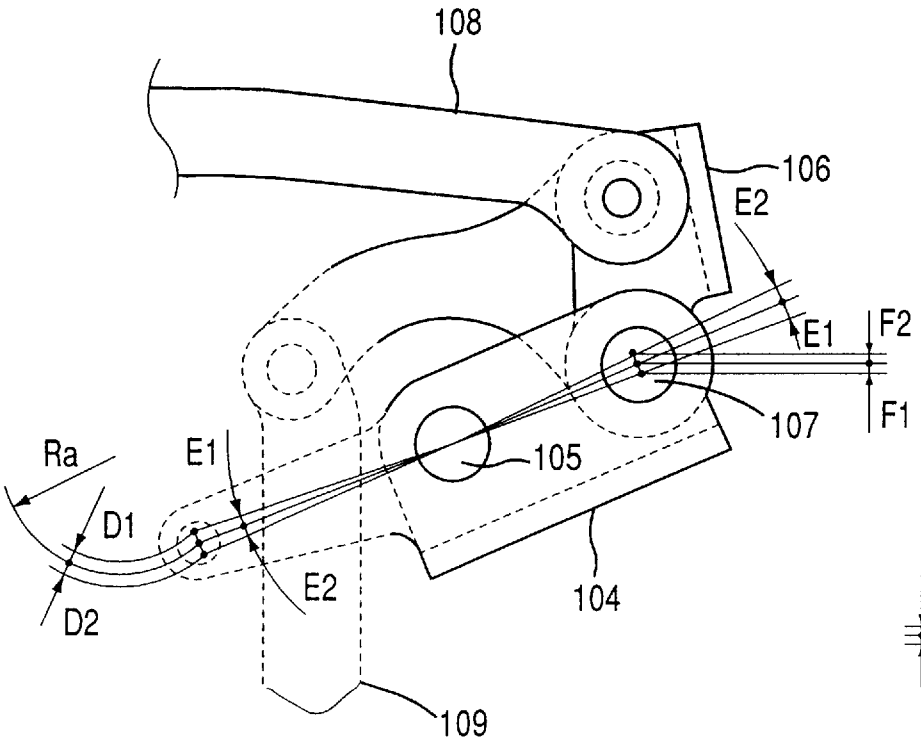
Figure 23:
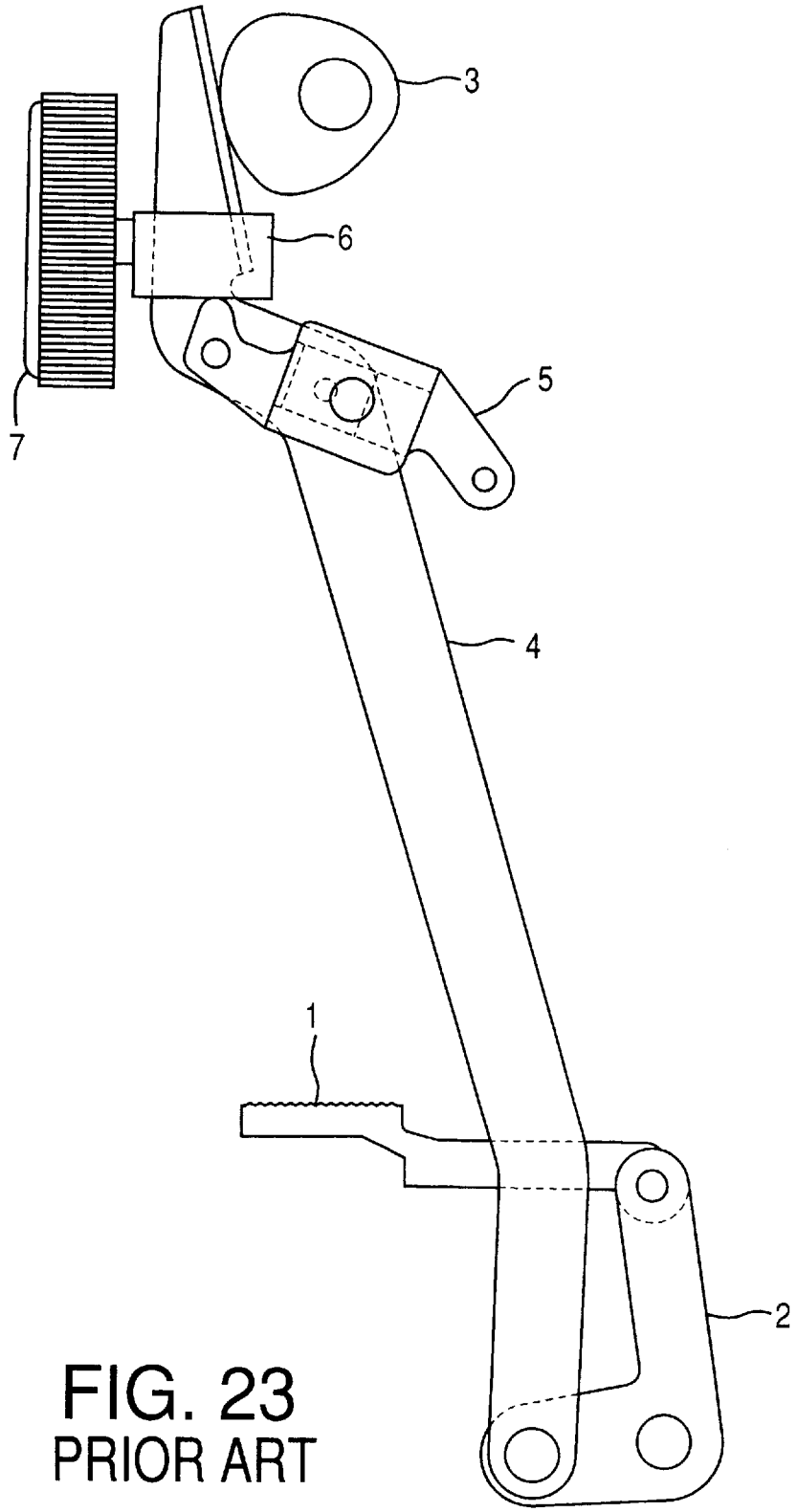
FIG. 23 PRIOR ART
FIG. 23 is a view showing a part of a known fabric feeding device.

In the present second embodiment using the feed adjusting dial 40 having the cam groove 40-*b*, the feed control cam 39 is shaped differently from that of the first embodiment. As in the first embodiment, the lift amount of the reverse feed cam 38 of the second embodiment is held constant at the predetermined value within the angular range A–B of the dial 40, as indicated in the upper graph of FIG. 20. Therefore, the feed distance in the reverse direction during an ordinary or straight stitching operation (other than the operations to sew buttonhole patterns and super patterns) cannot be adjusted to a small value within the range corresponding to the angular range A–B. In the light of this fact, the forward feed cam 37 according to the present second embodiment has a reverse feed cam portion 37-*a*, as shown in solid line in FIG. 19 and as indicated in FIG. 20. This reverse feed cam portion 37-*a* can be used for adjusting the reverse feed distance in the ordinary sewing operation, namely, a straight stitching operation. That is, the reverse feed cam portion 37-*a* is a straight stitching reverse feed cam portion used for controlling the reverse feed distance in the straight stitching operation. The lower limit point A of the above-indicated range A–B of the forward feed cam 37 corresponds to the zero value of the forward feed distance. The reverse feed cam portion 37-*a* extends between the point A and a point C which is remote from the upper limit point B of the range A–B, as indicated in the upper graph of FIG. 20. The angular range or distance between the points A and C is equal to the angular range or distance between the points A and B. It will be understood that the reverse feed cam portion 37-*a* of the forward feed cam 37 functions as if the reverse feed cam 38 had a portion indicated by two-dot chain line in the graph.

The reverse feed cam portion 37-*a* has a width (in the radial direction of the feed control cam 39), which is almost equal to but is slightly larger than the diameter of the pin 41-*d*. That is, when the feed adjusting dial 40 is rotated to a position in which the pin 41-*d* is in the reverse feed cam portion 37-*a* of the forward feed cam 37, for performing a reverse feeding action in an ordinary sewing operation, the pin 41-*d* is held in contact with the cam surface of the reverse feed cam portion 37-*a*, without having to hold the forward-reverse switching lever 42 in the lower position in which the control plate 41 is placed in the lower reverse-feed position.

When an ordinary stitching operation is effected with the fabric being fed in the reverse direction, the machine operator is generally required to hold the forward-reverse switching lever (42) in the reverse stitching position with one hand, while holding the work fabric with the other hand. In the presence of the reverse feed cam portion 37-*a* used for adjusting the reverse feed distance in an ordinary sewing operation, the reverse stitching operation may be effected with the feed adjusting dial 40 set for a desired position along the reverse feed cam portion 37-*a* of the forward feed cam 37, while the work fabric is held by the two hands of the machine operator. In other words, the reverse feed cam portion 37-*a* eliminates the conventional need of holding the forward-reverse switching lever in the reverse stitching position.

The feed control cam 39 used in the present second embodiment is further different from that in the first embodiment, in that the ends of the forward and reverse feed cams 37–38 remote from the reverse feed cam portion 37-*a* are located close to the extreme end of the reverse feed cam portion 37-*a*. As indicated by two-dot chain line in FIG. 19, the cams 37, 38 in the second embodiment extend over a considerably larger angular range than those in the first embodiment, such that the distance between the opposed surfaces of the cams 37, 38 in the radial direction of the feed control cam 39 increases in the clockwise direction as seen in FIG. 19, so that the radial distance is considerably large over the angular range corresponding to the angular range between the positions D and E of the cam groove 40-*d* formed in the feed adjusting dial 40. The arrangement of the feed control cam 39 described above permits the cam groove 40-*d* and the feed control cam 39 to function as intended, without an interference with each other.

The description now refers back to the operation of the dial 40 from the super pattern position A to the position for a stitching operation other than the super pattern stitching operation. As the dial 40 is rotated from the super pattern position A of FIG. 14 toward the intermediate position D of FIG. 18, the holder 104 is rotated about the shaft 105 through the engagement between the pin 104-*a* and the cam surface of the cam groove 40-*a* of the dial 40, whereby the axis of the shaft 107 is moved in the upward direction as seen in FIG. 17. As a result, the lever 106 is also moved upward, so that the cam follower 103 is moved through the connecting lever 108 such that the follower pin 103-*a* is moved or spaced away from the surface of the feed cam 101 with the aid of the biasing force of the tension spring 111. In this position, the rotation of the super pattern feed cam 101 will not affect the feed distance. After the cam follower 103 has come into contact with a stop 10-*a* provided on the frame 10, as indicated in FIG. 17, a further rotary motion of the dial 40 will cause the lever 106 to be rotated so as to move up the control lever 109, so that the pin 110 fixed to the feed regulator 5 of the horizontal motion mechanism 127 is spaced apart from the upper end of an elongate hole 109-*a* formed in the control lever 109, as shown in FIG. 16. In this position, the control lever 109 does not act on or interfere with the feed regulator 5 even when the dial 40 (feed control cam 39) is rotated within the angular range between the positions D and E, to adjust the forward or reverse feed distance, even to the maximum value, by means of the forward or reverse feed cam 37, 38 or buttonhole reverse feed auxiliary cam 39-*a*, for the sewing operation other than the operation to sew a super pattern.

In the other aspects, the second embodiment is identical with the first embodiment.

While the presently preferred embodiment of the invention has been described above by reference to the accompanying drawings, it is to be understood that the present invention is not limited to the details of the illustrated embodiment, but may be embodied with various changes, modifications and improvements, which may occur to those skilled in the art, without departing from the spirit and scope of the invention defined in the following claims;

What is claimed is:

1. A fabric feeding device for a sewing machine, for feeding a work fabric during sewing of a buttonhole pattern having a right side part and a left side part which are sewn by one and the other of a forward feeding and a reverse feeding of the work fabric, and a bar tack part which connects said right and left side parts, said fabric feeding device comprising:

a feed dog for feeding said work fabric;

a drive lever for horizontally reciprocating said feed dog;

an oscillating rod for oscillating said drive lever;

a drive cam rotated by a drive source of the sewing machine, to oscillate said oscillating rod;

a vertical motion mechanism for vertically reciprocating said feed dog, in synchronization with a horizontal reciprocating movement of said feed dog;

a feed regulator associated with said oscillating rod, for changing an oscillating angle of said drive lever;

a feed control cam member including a forward feed cam and a reverse feed cam for controlling a forward feed distance and a reverse feed distance of said feed dog, respectively;

an operator-controlled feed adjusting member for operating said feed control cam member;

a control plate whose position is changed by said feed control cam member, for changing the angle of said feed regulator;

an operator-controlled pattern selector member for selecting a stitching pattern to be sewn on said work fabric;

an auxiliary feed cam member which has a cam portion and which is operated by said pattern selector member;

at least one auxiliary feed plate whose position is changed by said cam portion of said auxiliary feed cam member and which cooperates with said feed control cam member to move said control plate;

an operator-controlled buttonhole fine feed adjusting member which is supported by a frame of the sewing machine and whose position is adjustable;

a buttonhole reverse feed auxiliary cam member operated by said operator-controlled feed adjusting member; and a buttonhole fine feed adjusting lever rotatably supported by said buttonhole fine feed adjusting member and positioned by said buttonhole reverse feed auxiliary cam member, for positioning said at least one auxiliary feed plate, and wherein said reverse feed cam of said feed control cam member is shaped such that a part of said reverse feed cam corresponding a small-feed range whose upper limit is a predetermined value does not disturb positioning of said control plate by said buttonhole reverse feed auxiliary cam member, said buttonhole fine feed adjusting lever and said at least one auxiliary feed plate.

2. A fabric feeding device according to claim 1, wherein said forward feed cam of said feed control cam member includes a reverse feed cam portion for controlling the reverse feed distance of said feed dog.

3. A fabric feeding device according to claim 2, wherein said reverse feed cam portion of said forward feed cam includes a section corresponding to said small-feed range of said reverse feed cam.

4. A fabric feed control device for controlling a feed distance of a horizontally and vertically reciprocable feed dog of a sewing machine for feeding a work fabric during sewing of a buttonhole pattern having a right side part and a left side part which are sewn by one and the other of a forward feeding and a reverse feeding of the work fabric, and at least one bar tack portion which connects said right and left side parts, said fabric feed control device comprising:

an operator-controlled selector member for selecting one of stitching operations to sew said right and left side parts and said bar tack portion of said buttonhole pattern;

a selector cam member operated by said operator-controlled selector member;

a forward feed cam for controlling a forward feed distance of said feed dog for said forward feeding of said work fabric when the stitching operation to sew one of said right and left side parts is selected by said selector member through said selector cam member;

a reverse feed cam for controlling a reverse feed distance of said feed dog for said reverse feeding of said work fabric when the stitching operation to sew the other of said right and left side parts is selected by said selector member through said selector cam member; and a bar tack feed control device for controlling a bar tack feed distance of said feed dog for sewing said bar tack portion when the stitching operation to sew said bar tack portion is selected by said selector member through said selector cam member.

5. A fabric feed control device according to claim 4, wherein said forward feed cam for said forward feeding of said work fabric during sewing of said buttonhole pattern is also used for controlling a forward feed distance of said feed dog when a straight stitching operation is performed on said work fabric.

6. A fabric feed control device according to claim 4, further comprising a straight stitching reverse feed cam in addition to said reverse feed cam as a buttonhole stitching reverse feed cam which controls the reverse feed distance during sewing of said buttonhole pattern, and wherein said straight stitching reverse feed cam is used for controlling a reverse feed distance of said feed dog during a straight stitching operation.

7. A fabric feed control device according to claim 6, wherein said straight stitching reverse feed cam is shaped such that a part of said straight stitching reverse feed cam corresponding to a small-feed range whose upper limit is a predetermined value does not disturb controlling of said feed dog by said buttonhole stitching reverse feed cam.

8. A fabric feed control device according to claim 7, wherein said part of said straight stitching reverse feed cam is shaped so as to maintain said reverse feed distance during said straight stitching at a predetermined constant value.

9. A fabric feed control device according to claim 4, further comprising a feed ratio changing device for adjusting said reverse feed distance of said feed dog as controlled by said reverse feed cam for said reverse feeding of said work fabric when said stitching operation to sew said other of said right and left side parts is selected by said operator-controlled selector member through said selector cam member, independently of said forward feed distance of said feed dog as controlled by said forward feed cam for said forward feeding of said work fabric when said stitching operation to sew said one of said right and left side parts is selected by said selector member through said selector cam member, whereby a ratio of said reverse feed distance to said forward feed distance is changed by said feed ratio changing device.

10. A fabric feed control device according to claim 4, further comprising a cam follower engageable with said selector cam member, and wherein said bar tack feed control device includes a mechanism for operatively connecting said feed dog to said cam follower such that said bar tack feed distance of said feed dog is zero.

11. A fabric feed control device according to claim 5, wherein said forward feed cam includes a straight stitching forward feed cam portion for controlling said forward feed distance of said feed dog during said straight stitching operation, and a straight stitching reverse feed cam portion which is formed adjacent to said straight stitching forward feed cam portion and which is used for controlling said reverse feed distance of said feed dog during said straight stitching operation.

12. A fabric feed control device according to claim 11, further comprising a straight stitching reverse feed cam in addition to said reverse feed cam as a buttonhole stitching reverse feed cam which controls the reverse feed distance during sewing of said buttonhole pattern, and wherein said straight stitching reverse feed cam is used for controlling a reverse feed distance of said feed dog during a straight stitching operation, said straight stitching reverse feed cam is shaped such that a part of said straight stitching reverse feed cam corresponding to a small-feed range whose upper limit is a predetermined value does not disturb controlling of said feed dog by said buttonhole stitching reverse feed cam, said straight stitching reverse feed cam portion of said forward feed cam including a section corresponding to said small-feed range of said straight stitching reverse feed cam.

13. A fabric feed control device for controlling a feed distance of a horizontally and vertically reciprocable feed dog of a sewing machine for feeding a work fabric, said fabric feed control device comprising;

a feed control cam member having a forward feed cam surface and a reverse feed cam surface which are formed in a mutually opposed relationship with each other, for controlling a forward feed distance and a reverse feed distance of said feed dog for forward and reverse feedings of said work fabric, respectively;

a cam follower normally held in engagement with said forward feed cam surface under a biasing force of a biasing member, said cam follower being brought into engagement with said reverse feed cam surface when a force overcoming said biasing force is applied to said cam follower in a direction from said forward feed cam surface toward said reverse feed cam surface;

an operator-controlled switching member for applying said force overcoming said biasing force to said cam follower;

a mechanism for operatively connecting said cam follower to said feed dog, such that said forward and reverse feed distances change depending upon a position of engagement of said cam follower with said forward and reverse feed cam surfaces; and a straight stitching reverse feed cam portion formed adjacent to one of opposite end portions of said forward feed cam surface, for controlling the reverse feed distance of said feed dog during a straight stitching operation on said work fabric, said straight stitching reverse feed cam portion being opposed to said reverse feed cam surface, said forward feed cam surface being shaped such that said forward feed distance is smaller when said cam follower is in engagement with said one end portion of said forward feed cam surface than when said cam follower is in engagement with the other end portion.

14. A fabric feed control device for controlling a feed distance of a horizontally and vertically reciprocable feed dog of a sewing machine for feeding a work fabric during sewing of a buttonhole pattern having a right side part and a left side part which are sewn by one and the other of a forward feeding and a reverse feeding of the work fabric, and at least one bar tack portion which connects said right and left side parts, said fabric feed control device comprising:

a forward feed cam for controlling a forward feed distance of said feed dog for said forward feeding of said work fabric;

a first reverse feed cam for controlling a reverse feed distance of said feed dog for said reverse feeding of said work fabric, within a small-feed range whose upper limit is a predetermined value;

a second reverse feed cam for controlling said reverse feed distance within a large-feed range whose lower limit is said predetermined value; and a fine reverse feed adjusting device for effecting fine adjustment of said reverse feed distance controlled by said first reverse feed cam within said small-feed range, without an influence on said forward feed distance controlled by said forward feed cam and on said reverse feed distance controlled by said second reverse feed cam within said large-feed range.

15. A fabric feed control device according to claim 14, further comprising:

an operator-controlled selector member for selecting one of stitching operations which includes stitching operations to sew said right and left side parts of said buttonhole pattern;

a selector cam member operated by said operator-controlled selector member;

a buttonhole stitching forward feed control mechanism including said forward feed cam and a forward feed cam follower engageable with said forward feed cam, said buttonhole stitching forward feed control mechanism being operable for controlling said forward feed distance of said feed dog for said forward feeding of said work fabric, based on a position of engagement of said forward feed cam follower with said forward feed cam, when the stitching operation to sew one of said right and left side parts of said buttonhole pattern is selected by said operator-controlled selector member through said selector cam member; and a buttonhole stitching reverse feed control mechanism including said first reverse feed cam and a reverse feed cam follower engageable with said first reverse feed cam, said buttonhole stitching reverse feed control mechanism being operable for controlling said reverse feed distance of said feed dog for said reverse feeding of said work fabric, based on a position of engagement of said reverse feed cam follower with said first reverse feed cam, when the stitching operation to sew the other of said right and left side parts is selected by said selector member through said selector cam member, and wherein said fine reverse feed adjusting device is provided in said buttonhole stitching reverse feed control mechanism, and includes a relative position adjusting device for changing a relative position of said reverse feed cam follower and said feed dog.

16. A fabric feed control device according to claim 15, wherein said relative position adjusting device includes at least one lever rotatable about an axis, and a device for changing a position of said axis of said at least one lever.

17. A fabric feed control device for controlling a feed distance of a horizontally and vertically reciprocable feed dog of a sewing machine for feeding a work fabric during sewing of a super pattern which is sewn by both a forward feeding and a reverse feeding of said work fabric, or a buttonhole pattern having a right side part and a left side part which are sewn by one and the other of said forward and reverse feedings of said work fabric, and at least one bar tack portion which connects said right and left side parts, said fabric feed control device comprising:

a super pattern feed cam rotated by a drive source of the sewing machine, for forming said super pattern;

a super pattern feed cam follower engageable with said super pattern feed cam;

a transmission mechanism for transmitting a motion of said super pattern feed cam follower to said feed dog;

a first fine feed adjusting device provided in said transmission mechanism, for changing a ratio of said forward and reverse feed distances of said feed dog which are controlled by said super pattern feed cam for said forward and reverse feedings of said work fabric;

an operator-controlled feed control cam member operable for sewing of said buttonhole pattern, said feed control cam member including a forward feed cam portion for controlling said forward feed distance of said feed dog for said forward feeding of said work fabric, a first reverse feed cam portion for controlling a reverse feed distance of said feed dog for said reverse feeding of said work fabric, within a small-feed range whose upper limit is a predetermined value, and a second reverse feed cam portion for controlling said reverse feed distance within a large-feed range whose lower limit is said predetermined value; and a second fine feed adjusting device for effecting fine adjustment of said reverse feed distance of said feed dog which is controlled by said first reverse feed cam for said reverse feeding of said work fabric within said small-feed range, without an influence on said forward feed distance controlled by said forward feed cam and on said reverse feed distance controlled by said second reverse feed cam within said large-feed range, and without an influence on said ratio of said forward and reverse feed distances changed by said first fine feed adjusting device.

18. A fabric feed control device according to claim 17, wherein said first fine feed adjusting device includes a relative position adjusting device for changing a relative position of said cam follower and said feed dog.

19. A fabric feed control device according to claim 18, wherein said relative position adjusting device includes at least one lever rotatable about an axis, and a device for changing a position of said axis of said at least one lever.

20. A fabric feed control device according to claim 17, wherein said transmission mechanism comprises:

a drive lever for reciprocating said feed dog;

an oscillating rod for oscillating said drive lever;

a drive cam rotated by said drive source, for oscillating said oscillating rod;

a feed regulator associated with said oscillating rod, for changing an oscillating angle of said drive lever; and a super pattern motion mechanism for operatively connecting said super pattern feed cam follower and said feed regulator.

21. A fabric feed control device according to claim 20, further comprising:

a first cam follower selectively engageable with said forward cam and said second reverse feed cam portion of said operator-controlled feed control cam member;

a first connecting mechanism for operatively connecting said first cam follower and said feed regulator;

a second cam folower engageable with said first reverse feed cam portion of said operator-controlled feed control cam member; and a second connecting mechanism for operatively connecting said second cam follower and said feed regulator.

22. A fabric feed control device according to claim 21, wherein said first and second connecting mechanisms include a common first control member engaging said feed regulator, and said super pattern motion mechanism includes a second control member which engages said feed regulator and which is different from said common first control member of said first and second connecting mechanisms.

* * * * *